US011493213B2

(12) United States Patent
Kurokawa et al.

(10) Patent No.: US 11,493,213 B2
(45) Date of Patent: Nov. 8, 2022

(54) OUTDOOR UNIT FOR REFRIGERATION APPARATUS

(71) Applicant: Daikin Industries, LTD., Osaka (JP)

(72) Inventors: Miho Kurokawa, Osaka (JP); Shigeki Kamitani, Osaka (JP); Taichi Koshiji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 342 days.

(21) Appl. No.: 16/625,925

(22) PCT Filed: Aug. 6, 2018

(86) PCT No.: PCT/JP2018/029403
§ 371 (c)(1),
(2) Date: Dec. 23, 2019

(87) PCT Pub. No.: WO2019/031448
PCT Pub. Date: Feb. 14, 2019

(65) Prior Publication Data

US 2020/0182491 A1 Jun. 11, 2020

(30) Foreign Application Priority Data

Aug. 9, 2017 (JP) ..... JP2017-154719

(51) Int. Cl.
*F24F 1/24* (2011.01)
*F24F 1/22* (2011.01)
*F24F 1/50* (2011.01)

(52) U.S. Cl.
CPC ..... *F24F 1/24* (2013.01); *F24F 1/22* (2013.01); *F24F 1/50* (2013.01)

(58) Field of Classification Search
CPC ..... F24F 1/24; F24F 1/22; F24F 1/50
(Continued)

(56) References Cited

U.S. PATENT DOCUMENTS

2005/0098300 A1* 5/2005 Kawabata ..... F28F 3/02 165/80.3
2009/0133423 A1 5/2009 Jang et al.
(Continued)

FOREIGN PATENT DOCUMENTS

CN 101231005 A 7/2008
CN 101440982 A 5/2009
(Continued)

OTHER PUBLICATIONS

Extended European Search Report, dated Aug. 3, 2020, for European Application No. 18844140.6.

*Primary Examiner* — Steve S Tanenbaum
(74) *Attorney, Agent, or Firm* — Birch, Stewart, Kolasch & Birch, LLP

(57) ABSTRACT

Provided is an outdoor unit for a refrigeration apparatus, the outdoor unit being capable of suppressing decrease in reliability. An outdoor unit (10) includes: a compressor (12); an outdoor fan (18) configured to provide outdoor air flows (AF), the outdoor fan (18) being higher in heightwise position than the compressor (12); a high-heat generating electric component (65) configured to control the compressor (12); a fan controlling electric component (66) configured to control the outdoor fan (18); a board unit (75) including a compressor controlling electric component mount portion (75*a*) and a fan controlling electric component mount portion (75*b*); a first cooling unit (80); and an outdoor unit casing (40). The outdoor air flows (AF) flow from below upward in the outdoor unit casing (40), and flow out of the outdoor unit casing (40) through a blow-out port (402). The first cooling unit (80) includes a plurality of first cooling unit fins (81) located on flow paths of the outdoor air flows (AF), the first cooling unit fins (81) being adjacent to the compressor controlling electric component mount portion (75*a*). The high-heat generating electric component (65)
(Continued)

is lower in heightwise position than the outdoor fan (18) and higher in heightwise position than the fan controlling electric component (66).

8 Claims, 29 Drawing Sheets

(58) Field of Classification Search
USPC ..... 62/259.2
See application file for complete search history.

(56) References Cited

U.S. PATENT DOCUMENTS

| | | | |
|---|---|---|---|
| 2009/0137197 | A1 | 5/2009 | Jang et al. |
| 2012/0247735 | A1 | 10/2012 | Ito et al. |
| 2013/0112373 | A1 | 5/2013 | Fukai et al. |
| 2015/0059389 | A1 | 3/2015 | Liu et al. |
| 2016/0174411 | A1 | 6/2016 | Lee et al. |
| 2016/0320077 | A1 | 11/2016 | Kim et al. |

FOREIGN PATENT DOCUMENTS

| | | | | |
|---|---|---|---|---|
| CN | 202082976 | U | | 12/2011 |
| CN | 102458081 | A | | 5/2012 |
| CN | 106091168 | A | | 11/2016 |
| EP | 2762792 | A1 | | 8/2014 |
| JP | 61-129349 | U | | 8/1986 |
| JP | 1-208626 | A | | 8/1989 |
| JP | 4-98026 | A | | 3/1992 |
| JP | 2003-188321 | A | | 7/2003 |
| JP | 2003-214659 | A | | 7/2003 |
| JP | 2003188321 | A | * | 7/2003 |
| JP | 2004-116975 | A | | 4/2004 |
| JP | 2005-114341 | A | | 4/2005 |
| JP | 2005-300083 | A | | 10/2005 |
| JP | 2007-198684 | A | | 8/2007 |
| JP | 2007-218534 | A | | 8/2007 |
| JP | 2007218534 | A | * | 8/2007 |
| JP | 2011-181882 | A | | 9/2011 |
| JP | 2011-202889 | A | | 10/2011 |
| JP | 5196166 | B2 | | 5/2013 |
| JP | 2016-191505 | A | | 11/2016 |
| JP | 2018-17409 | A | | 2/2018 |
| WO | WO 2008/047820 | A1 | | 4/2008 |
| WO | WO 2011/105364 | A1 | | 9/2011 |

* cited by examiner

OUTDOOR UNIT FOR REFRIGERATION APPARATUS

TECHNICAL FIELD

The present invention relates to an outdoor unit for a refrigeration apparatus.

BACKGROUND ART

In some outdoor units for a refrigeration apparatus, a compressor is disposed on a bottom plate in a casing, and a fan configured to provide an air flow blows out air upward at a position higher than the compressor. As disclosed in, for example, Patent Literature 1 (Japanese Patent No. 5,196,166), in such an outdoor unit, typically, electric components configured to control devices such as a compressor and a fan are mounted on a board disposed in a casing.

The electric components mounted on the board include a heat generating component configured to generate heat when being energized. Such a heat generating component is cooled for ensuring reliability. According to the technique disclosed in Patent Literature 1, an air flow provided by a fan flows from below upward along a board to cool a heat generating component.

SUMMARY OF THE INVENTION

Technical Problem

Recently, most compressors are subjected to inverter control such that their capacities are variable. Typically, electric components to be mounted on a board include various electric components (e.g., a power device, a power module) configured to perform inverter control on such a compressor. Normally, electric components configured to control devices (e.g., a fan) other than the compressor are also mounted on the board.

In an outdoor unit having such a configuration, normally, a fan is higher in heightwise position than a compressor; therefore, a fan controlling electric component is disposed above a compressor controlling electric component, that is, the fan controlling electric component is closer to the fan than the compressor controlling electric component is, for the sake of ease of wiring.

As a result of diligent studies, however, the inventor of this application has found that this layout occasionally fails to ensure reliability since a heat generating component is unsatisfactorily cooled. Specifically, a compressor controlling heat generating component is normally larger in heating value than a fan controlling heat generating component. In cases where a heat generating component is cooled by an air flow flowing from below upward, the fan controlling heat generating component is cooled by the air flow heated by heat exchange with the compressor controlling heat generating component. It is consequently considered that the fan controlling heat generating component is unfavorably cooled because of an unsatisfactory temperature difference between the fan controlling heat generating component and the air flow as a cooling source. Decrease in reliability is caused due to this respect.

In cases where a heat generating component is cooled by an air flow flowing from below upward as disclosed in Patent Literature 1, an airflow volume at a position closer to a fan (i.e., an airflow volume on the leeward side) tends to become larger. It is however considered that when a compressor controlling heat generating component is on the windward side of an air flow with respect to a fan controlling heat generating component (i.e., when the compressor controlling heat generating component is farther from a fan than the fan controlling heat generating component is), an airflow volume of an air flow for cooling the compressor controlling heat generating component having a larger heating value is unsatisfactorily ensured, so that the compressor controlling heat generating component is unfavorably cooled. Decrease in reliability is also caused due to this respect.

Hence, the present invention provides an outdoor unit for a refrigeration apparatus, the outdoor unit being capable of suppressing decrease in reliability.

Solutions to Problem

According to a first aspect of the present invention, an outdoor unit for a refrigeration apparatus includes a compressor, a fan, a first electric component, a second electric component, a board part, a first cooler, and a casing. The compressor is configured to compress a refrigerant. The fan is higher in heightwise position than the compressor. The fan is configured to provide air flows. The first electric component is configured to control a driven state of the compressor. The second electric component is configured to control a driven state of the fan. The board part includes a first portion and a second portion. The first electric component is mounted on the first portion. The second electric component is mounted on the second portion. The first cooler is adjacent to the first portion. The first cooler is thermally connected to the first electric component. The first cooler is configured to cool the first electric component. The casing houses therein the compressor, the fan, and the board part. The casing has a blow-out port. The blow-out port is an opening through which the air flows are blown out upward. Each of the air flows is a flow of air flowing from below upward in the casing and flowing out of the casing through the blow-out port. The first cooler includes a plurality of first heat radiating fins. The first heat radiating fins are located on flow paths of the air flows. The first heat radiating fins are configured to exchange heat with the air flows. The first electric component is lower in heightwise position than the fan and higher in heightwise position than the second electric component.

In the outdoor unit according to the first aspect of the present invention, the fan that is higher in heightwise position than the compressor provides air flows flowing from below upward in the casing and flowing out of the casing through the blow-out port. In addition, the first cooler that is adjacent to the first portion and is configured to cool the first electric component includes the plurality of first heat radiating fins located on flow paths of the air flows and configured to exchange heat with the air flows. In addition, the first electric component is lower in heightwise position than the fan and higher in heightwise position than the second electric component. This configuration facilitates favorable cooling of both the first electric component configured to control the compressor and the second electric component configured to control the fan, thereby suppressing decrease in reliability.

Specifically, in cooling the first electric component and the second electric component using, as a cooling source, air flows flowing from below upward, when the first cooler including the first heat radiating fins is adjacent to the first portion (the first electric component), and the first electric component is lower in heightwise position than the fan and higher in heightwise position than the second electric component, the second electric component is on the windward side of the air flows with respect to the first electric component (the first heat radiating fins). Therefore, the second electric component is cooled by the air flows prior to the first electric component. This configuration thus suppresses a situation in which the second electric component is unfavorably cooled because of an unsatisfactory temperature difference between the second electric component and the air flows.

In addition, the first electric component (the first heat radiating fins) is on the leeward side of the air flows with respect to the second electric component. In other words, the first electric component (the first heat radiating fins) is closer to the fan than the second electric component is. This configuration therefore facilitates ensuring of a satisfactory airflow volume of air flows for cooling the first electric component larger in heating value than the second electric component. This configuration thus facilitates favorable cooling of the first electric component.

The first electric component (the first heat radiating fins) is cooled by the air flows subjected to heat exchange with the second electric component. However, since the second electric component is smaller in heating value than the first electric component, this configuration also suppresses a situation in which a temperature difference between the first electric component and the air flows as the cooling source is unsatisfactorily ensured. Also in this respect, this configuration suppresses the situation in which the first electric component is unfavorably cooled.

This configuration thus suppresses decrease in reliability.

The "first electric component" used herein refers to, for example, a power device, such as an insulated gate bipolar transistor (IGBT), that is considerably larger in heating value than the second electric component or a power module including the power device. The "second electric component" used herein refers to, for example, a heat generating component such as a capacitor or a semiconductor element.

The "board part" used herein refers to a component including at least one board on which an electric component is mounted. The board part may include a plurality of boards.

The state "thermally connected" used herein is not limited to a case where the "first cooler" and the "first electric component" are in direct contact with each other as long as the "first cooler" and the "first electric component" are disposed in a heat-exchangeable state. For example, the state "thermally connected" involves a case where the "first cooler" and the "first electric component" are disposed with a heat-transmissive object interposed therebetween, and a case where the "first cooler" and the "first electric component" are disposed with a clearance formed therebetween (i.e., a case where the "first cooler" and the "first electric component" are spaced apart from each other).

In addition, the state "flowing from below upward in the casing" used herein does not intend to deny air flows partially flowing horizontally and air flows flowing from above downward. In other words, the state "flowing from below upward in the casing" involves a case where air flows flow horizontally in the casing, and then flow from below upward toward the blow-out port, and a case where air flows flow from above downward, and then flow from below upward toward the blow-out port.

According to a second aspect of the present invention, the outdoor unit for the refrigeration apparatus according to the first aspect further includes a second cooler. The second cooler is thermally connected to the second electric component. The second cooler is configured to cool the second electric component. The second cooler includes a plurality of second heat radiating fins. The second heat radiating fins are configured to exchange heat with the air flows. The first heat radiating fins are higher in heightwise position than the second heat radiating fins.

This configuration facilitates cooling of the second electric component while ensuring cooling performance for the first electric component having a larger heating value. Specifically, this configuration facilitates heat exchange between the second electric component and the air flows by the second heat radiating fins, thereby increasing a cooling value of the second electric component. When the second heat radiating fins are on the leeward side of the air flows with respect to the first heat radiating fins, it is supposed that the second electric component is unfavorably cooled in some cases because of an unsatisfactory temperature difference between the second heat radiating fins and the air flows. However, this configuration suppresses such a situation since the second heat radiating fins are on the windward side of the air flows with respect to the first heat radiating fins. In addition, since the second electric component is normally smaller in heating value than the first electric component, even when the first heat radiating fins are on the leeward side of the air flows with respect to the second heat radiating fins (i.e., even when the first heat radiating fins are cooled by the air flows subjected to heat exchange with the second heat radiating fins), the temperature difference between the first heat radiating fins and the air flows is satisfactorily ensured, so that the first electric component is satisfactorily cooled. This configuration thus further suppresses decrease in reliability.

The state "thermally connected" used herein is not limited to a case where the "second cooler" and the "second electric component" are in direct contact with each other as long as the "second cooler" and the "second electric component" are disposed in a heat-exchangeable state. For example, the state "thermally connected" involves a case where the "second cooler" and the "second electric component" are disposed with a heat-transmissive object interposed therebetween, and a case where the "second cooler" and the "second electric component" are disposed with a clearance formed therebetween (i.e., a case where the "second cooler" and the "second electric component" are spaced apart from each other).

According to a third aspect of the present invention, in the outdoor unit for the refrigeration apparatus according to the second aspect, the first heat radiating fins of the first cooler are arranged with a first fin pitch. The second heat radiating fins of the second cooler are arranged with a second fin pitch. The first fin pitch is shorter than the second fin pitch.

When the fin pitch between the first heat radiating fins is shorter than the fin pitch between the second heat radiating fins, heat exchange with the air flows is facilitated in the first cooler, which leads to improvement in cooling performance. Meanwhile, an airflow volume of air flows passing the first cooler needs to be larger than an airflow volume of air flows passing the second cooler in order that each first heat radiating fin favorably exchanges heat with an air flow. Specifically, when the first heat radiating fins are arranged with a shorter fin pitch, the number of first heat radiating fins is increased, which leads to improvement in heat radiating performance. However, the first heat radiating fins are arranged at a higher density, which may result in a situation in which an air flow is less prone to favorably pass between two of the first heat radiating fins. In view of this, in order to arrange the first heat radiating fins with a shorter fin pitch, it is necessary to increase an airflow volume of air flows passing the first heat radiating fins in accordance with the fin pitch such that an air flow favorably passes between two of the first heat radiating fins from the viewpoint of allowing each first heat radiating fin to satisfactorily exchange heat with an air flow.

In the outdoor unit according to the third aspect of the present invention, the first heat radiating fins of the first cooler are arranged with a fin pitch that is shorter than that between the second heat radiating fins of the second cooler. The first heat radiating fins are lower in heightwise position than the fan and higher in heightwise position than the second heat radiating fins (i.e., closer to the fan than the second heat radiating fins are). This configuration thus facilitates improvement in cooling performance of the first cooler. Specifically, when the fin pitch between the first heat radiating fins of the first cooler is shorter than the fin pitch between the second heat radiating fins of the second cooler, the number of first heat radiating fins is increased. In addition, the airflow volume of the air flows passing the first heat radiating fins of the first cooler is ensured to be larger than the airflow volume of the air flows passing the second heat radiating fins. As a result, the airflow volume of the air flows passing the first heat radiating fins is increased in accordance with the fin pitch such that an air flow favorably passes between two of the first heat radiating fins, which leads to suppression of the situation in which an air flow is less prone to favorably pass between two of the first heat radiating fins. This configuration thus facilitates improvement in cooling performance of the first cooler.

According a fourth aspect of the present invention, in the outdoor unit for the refrigeration apparatus according to any of the first to third aspects, the first electric component includes a power device or a power module. The power device is larger in heating value upon energization than the second electric component. The power module includes the power device.

The outdoor unit according to the fourth aspect of the present invention facilitates satisfactory cooling of the first electric component, and facilitates improvement in reliability even when the first electric component is a power device or a power module (i.e., even when the first electric component has a particularly larger heating value).

The "power device" used herein refers to, for example, a semiconductor element for power control, such as an insulated gate bipolar transistor (IGBT) in an inverter. The "power module" used herein refers to, for example, an intelligent power module (IPM) including a power device.

According to a fifth aspect of the present invention, in the outdoor unit for the refrigeration apparatus according to any of the first to fourth aspects, the first cooler further includes a heat pipe. A coolant is sealed in the heat pipe. The coolant is used for heat exchange with the first electric component. The heat pipe is interposed between the first electric component and the first heat radiating fins. The heat pipe is thermally connected to the first electric component and the first heat radiating fins.

In the outdoor unit according to the fifth aspect of the present invention, the first electric component is cooled by the heat pipe that is excellent in cooling performance. This configuration therefore ensures a larger cooling value of the first electric component having a larger heating value, and particularly facilitates improvement in reliability.

According to a sixth aspect of the present invention, in the outdoor unit for the refrigeration apparatus according to the fifth aspect, the heat pipe is disposed with its longitudinal axis extending horizontally.

This configuration suppresses a situation in which the coolant frozen in the heat pipe bursts the heat pipe (frost bursting). Specifically, the configuration in that the heat pipe is disposed in the horizontal direction suppresses freezing of the coolant even under an environment of low outside temperature. This configuration therefore suppresses decrease in reliability in cooling the electric components using the heat pipe.

The state in which "the longitudinal axis extends horizontally" used herein involves not only a case where the longitudinal axis of the heat pipe exactly extends in the horizontal direction, but also a case where the longitudinal axis of the heat pipe is tilted relative to the horizontal direction within a predetermined angular range (e.g., 30 degrees).

According to a seventh aspect of the present invention, the outdoor unit for the refrigeration apparatus according to any of the first to sixth aspects further includes an electric component box. The electric component box is disposed in the casing. The electric component box houses therein the board part. The electric component box has in its top face an exhaust port. Air is discharged through the exhaust port. The exhaust port is lower in heightwise position than the fan and higher in heightwise position than the first heat radiating fins.

In the outdoor unit according to the seventh aspect of the present invention, the exhaust port in the electric component box is lower in heightwise position than the fan and higher in heightwise position than the first heat radiating fins. In other words, the exhaust port in the electric component box is on the leeward side of the air flows with respect to the first heat radiating fins. This configuration suppresses a situation in which the air flows for heat exchange with the first heat radiating fins are heated by air to be discharged through the exhaust port in the electric component box. This configuration thus suppresses a situation in which the air discharged from the electric component box causes a small temperature difference between the first heat radiating fins and the air flows, and suppresses reduction in cooling value of the first electric component.

According to an eighth aspect of the present invention, in the outdoor unit for the refrigeration apparatus according to the seventh aspect, the electric component box includes a cover part spaced apart from the exhaust port and located on an upper side of the electric component box. The cover part is configured to suppress entry of liquid into the exhaust port.

This configuration therefore reliably suppresses the entry of liquid into the electric component box through the exhaust port, and improves reliability for a short circuit, corrosion, and the like as to each electric component.

According to a ninth aspect of the present invention, in the outdoor unit for the refrigeration apparatus according to any of the first to eighth aspects, the board part includes a first board and a second board. The first portion is disposed on the first board. The second portion is disposed on the second board.

The outdoor unit according to the ninth aspect of the present invention suppresses decrease in reliability even when the first portion is disposed on the first board and the second portion is disposed on the second board (i.e., even when the first electric component and the second electric component are respectively mounted on different boards).

Advantageous Effects of the Invention

In the outdoor unit according to the first aspect of the present invention, in cooling the first electric component and the second electric component using, as a cooling source, air flows flowing from below upward, when the first cooler including the first heat radiating fins is adjacent to the first portion (the first electric component), and the first electric component is lower in heightwise position than the fan and higher in heightwise position than the second electric component, the second electric component is on the windward side of the air flows with respect to the first electric component (the first heat radiating fins). Therefore, the second electric component is cooled by the air flows prior to the first electric component. This configuration thus suppresses a situation in which the second electric component is unfavorably cooled because of an unsatisfactory temperature difference between the second electric component and the air flows.

In addition, the first electric component (the first heat radiating fins) is on the leeward side of the air flows with respect to the second electric component. In other words, the first electric component (the first heat radiating fins) is closer to the fan than the second electric component is. This configuration therefore facilitates ensuring of a satisfactory airflow volume of air flows for cooling the first electric component larger in heating value than the second electric component. This configuration thus facilitates favorable cooling of the first electric component.

The first electric component is cooled by the air flows subjected to heat exchange with the second electric component. However, since the second electric component is smaller in heating value than the first electric component, this configuration also suppresses a situation in which a temperature difference between the first electric component and the air flows as the cooling source is unsatisfactorily ensured. Also in this respect, this configuration suppresses the situation in which the first electric component is unfavorably cooled.

This configuration thus suppresses decrease in reliability.

The outdoor unit according to the second aspect of the present invention further suppresses decrease in reliability.

The outdoor unit according to the third aspect of the present invention facilitates improvement in cooling performance of the first cooler.

The outdoor unit according to the fourth aspect of the present invention facilitates improvement in reliability even when the first electric component is a power device or a power module (i.e., even when the first electric component has a particularly larger heating value).

The outdoor unit according to the fifth aspect of the present invention particularly facilitates improvement in reliability.

The outdoor unit according to the sixth aspect of the present invention suppresses decrease in reliability in cooling the electric components using the heat pipe.

The outdoor unit according to the seventh aspect of the present invention suppresses reduction in cooling value of the first electric component.

The outdoor unit according to the eighth aspect of the present invention reliably suppresses the entry of liquid into the electric component box through the exhaust port, and improves reliability for a short circuit, corrosion, and the like as to each electric component.

The outdoor unit according to the ninth aspect of the present invention suppresses decrease in reliability even when the first portion is disposed on the first board and the second portion is disposed on the second board (i.e., even when the first electric component and the second electric component are respectively mounted on different boards).

DESCRIPTION OF EMBODIMENTS

An outdoor unit 10 according to an embodiment of the present invention will be described below with reference to the drawings. It should be noted that the following embodiment is merely a specific example of the present invention, does not intend to limit the technical scope of the present invention, and may be appropriately modified without departing from the gist of the present invention. In the following description, the terms "upper", "lower", "left", "right", "front", "rear", "front face", and "rear face" denote directions illustrated in FIGS. 2 to 29, unless otherwise specified (provided that the left side and the right side and/or the front side and the rear side may be turned appropriately in the following embodiment).

The outdoor unit 10 according to an embodiment of the present invention is applied to an air conditioning system 100 (a refrigeration apparatus).

(1) Air Conditioning System 100

Figure 1:
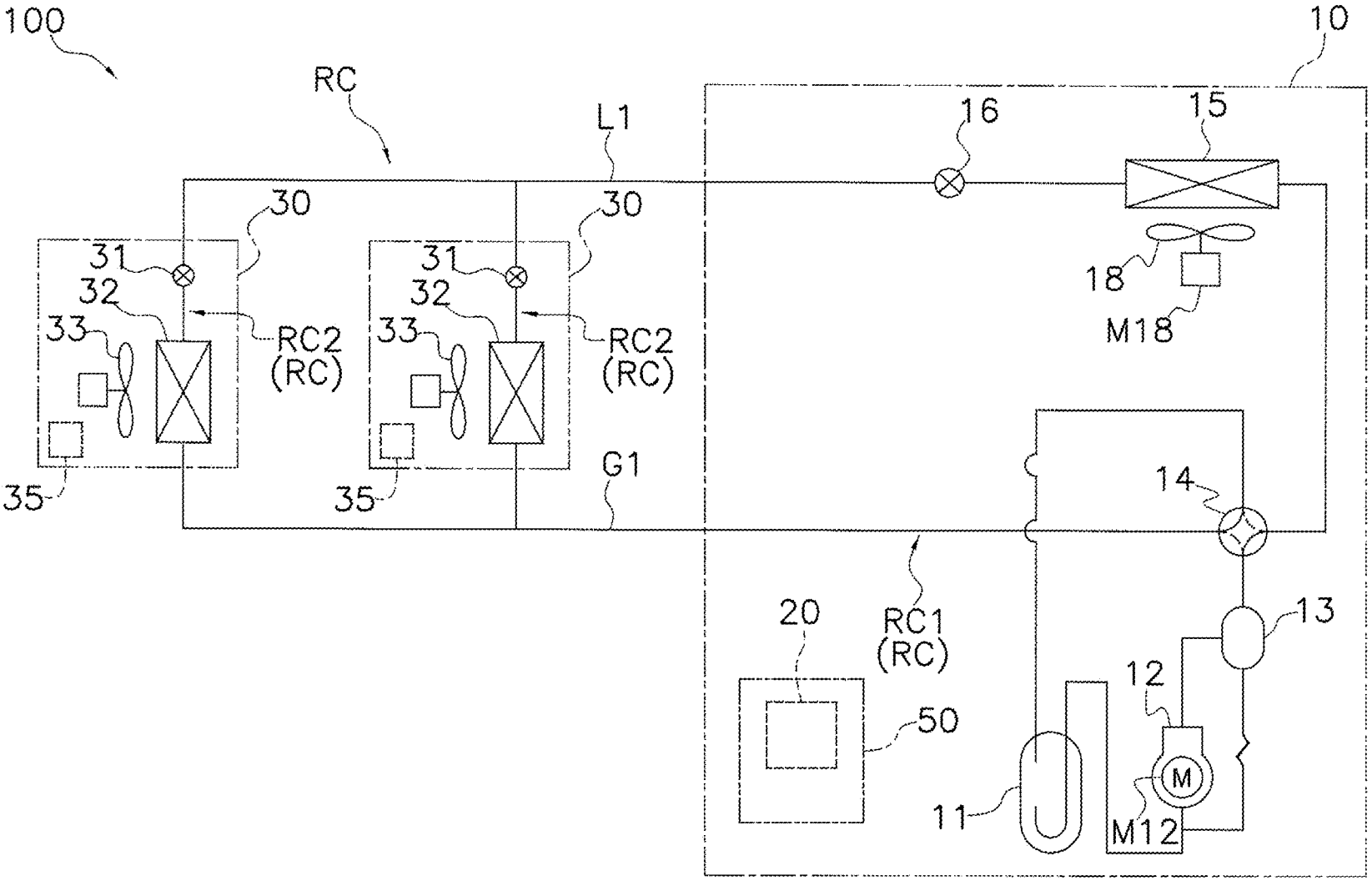
FIG. 1 is a schematic configuration diagram of an air conditioning system including an outdoor unit according to an embodiment of the present invention.

FIG. 1 is a schematic configuration diagram of the air conditioning system 100 including the outdoor unit 10 according to the embodiment of the present invention. The air conditioning system 100 is configured to perform air conditioning, such as cooling or heating, in a target space (a residential space, a space to be subjected to air conditioning in, for example, a store house) by a vapor compression refrigeration cycle. The air conditioning system 100 mainly includes the outdoor unit 10, a plurality of (two in this embodiment) indoor units 30 (30*a*, 30*b*), a liquid-side connection pipe L1, and a gas-side connection pipe G1.

In the air conditioning system 100, the outdoor unit 10 and the indoor units 30 are connected via the liquid-side connection pipe L1 and the gas-side connection pipe G1 to constitute a refrigerant circuit RC. The air conditioning system 100 performs a refrigeration cycle to compress, cool or condense, decompress, heat or evaporate, and then compress again a refrigerant in the refrigerant circuit RC.

(1-1) Outdoor Unit 10

The outdoor unit 10 is installed in outdoor space. The outdoor space refers to space other than a target space to be subjected to air conditioning, and examples thereof include the outside such as the roof of a building, and underground space. The outdoor unit 10 is connected to the indoor units 30 via the liquid-side connection pipe L1 and the gas-side connection pipe G1 to constitute a part (an outdoor-side circuit RC1) of the refrigerant circuit RC. The outdoor unit 10 mainly includes an accumulator 11, a compressor 12, an oil separator 13, a four-way switching valve 14, an outdoor heat exchanger 15, an outdoor expansion valve 16, and the like as devices that constitute the outdoor-side circuit RC1. These devices (11 to 16) are connected to one another via refrigerant pipes.

The accumulator 11 is a container configured to store the refrigerant and to separate the gas refrigerant from the liquid refrigerant, so as to suppress excessive suction of the liquid refrigerant into the compressor 12.

The compressor 12 is a device configured to compress the low-pressure refrigerant to the high-pressure refrigerant in the refrigeration cycle. The compressor 12 used in this embodiment is a hermetic compressor in which a displacement, such as rotary or scroll, compression element is driven to rotate by a compressor motor M12. The compressor motor M12 has an operating frequency controllable by an inverter, and controlling the operating frequency enables capacity control for the compressor 12. The start, stop, and operating capacity of the compressor 12 are controlled by an outdoor unit control unit 20.

The oil separator 13 is a container configured to separate a refrigerating machine oil compatible with the refrigerant discharged from the compressor 12 and to return the refrigerating machine oil to the compressor 12.

The four-way switching valve 14 is a flow path switching valve for switching a flow of the refrigerant in the refrigerant circuit RC.

The outdoor heat exchanger 15 is a heat exchanger that functions as a condenser (or a radiator) or an evaporator for the refrigerant.

The outdoor expansion valve 16 is an electric valve whose opening degree is controllable. The outdoor expansion valve 16 decompresses the incoming refrigerant or adjusts the flow rate of the incoming refrigerant, in accordance with the opening degree.

The outdoor unit 10 also includes an outdoor fan 18 (which is an example of a "fan" in the claims) configured to provide an outdoor air flow AF. The outdoor air flow AF (which is an example of an "air flow" in the claims) is a flow of air flowing into the outdoor unit 10 from the outside of the outdoor unit 10 and passing through the outdoor heat exchanger 15. The outdoor air flow AF serves as a cooling source or a heating source for the refrigerant flowing through the outdoor heat exchanger 15. The outdoor air flow AF passing through the outdoor heat exchanger 15 exchanges heat with the refrigerant in the outdoor heat exchanger 15. The outdoor fan 18 includes an outdoor fan motor M18, and is driven in conjunction with the outdoor fan motor M18. The start and stop of the outdoor fan 18 are appropriately controlled by the outdoor unit control unit 20. In this embodiment, the outdoor fan 18 (the outdoor fan motor M18) is not subjected to inverter control.

The outdoor unit 10 also includes a plurality of outdoor-side sensors (not illustrated) each configured to detect a state (mainly, a pressure, a temperature) of the refrigerant in the refrigerant circuit RC. Each of the outdoor-side sensors is a pressure sensor or a temperature sensor such as a thermistor or a thermocouple. The outdoor-side sensors include, for example, a suction pressure sensor configured to detect a suction pressure that is a pressure of the refrigerant at the suction side of the compressor 12, a discharge pressure sensor configured to detect a discharge pressure that is a pressure of the refrigerant at the discharge side of the compressor 12, and a temperature sensor configured to detect a temperature of the refrigerant in the outdoor heat exchanger 15.

The outdoor unit 10 also includes the outdoor unit control unit 20 configured to control operations and states of the devices in the outdoor unit 10. The outdoor unit control unit 20 includes: a microcomputer including a central processing unit (CPU), a memory, and the like, and various electric components (e.g., a capacitor, a semiconductor element, a coil component). The outdoor unit control unit 20 is electrically connected to the devices (e.g., 12, 14, 16, 18) and outdoor-side sensors in the outdoor unit 10 to exchange signals with the devices and outdoor-side sensors. The outdoor unit control unit 20 also exchanges, for example, control signals with indoor unit control units 35 of the respective indoor units 30 and remote controllers (not illustrated). The outdoor unit control unit 20 is housed in an electric component box 50 to be described later.

A specific description on the structure of the outdoor unit 10 will be given later.

(1-2) Indoor Units 30

Each indoor unit 30 is installed in the interior (e.g., a residential room, a roof-space), and constitutes a part (an indoor-side circuit RC2) of the refrigerant circuit RC. Each indoor unit 30 mainly includes an indoor expansion valve 31, an indoor heat exchanger 32, and the like as devices that constitute the indoor-side circuit RC2.

The indoor expansion valve 31 is an electric valve whose opening degree is controllable. The indoor expansion valve 31 decompresses the incoming refrigerant or adjusts the flow rate of the incoming refrigerant, in accordance with the opening degree.

The indoor heat exchanger 32 is a heat exchanger that functions as an evaporator or a condenser (or a radiator) for the refrigerant.

Each indoor unit 30 also includes an indoor fan 33 for sucking air inside a target space, allowing the air to pass through the indoor heat exchanger 32, causing the air to exchange heat with the refrigerant in the indoor heat exchanger 32, and then supplying the air to the target space again. The indoor fan 33 includes an indoor fan motor serving as a drive source. The indoor fan 33 is driven to provide an indoor air flow. The indoor air flow is a flow of air that flows into each indoor unit 30 from the target space, passes through the indoor heat exchanger 32, and then is blown out of the indoor unit 30 toward the target space. The indoor air flow serves as a heating source or a cooling source for the refrigerant flowing through the indoor heat exchanger 32. The indoor air flow passing through the indoor heat exchanger 32 exchanges heat with the refrigerant in the indoor heat exchanger 32.

Each indoor unit 30 also includes the indoor unit control unit 35 configured to control operations and states of the devices (e.g., 35) in the indoor unit 30. The indoor unit control unit 35 includes: a microcomputer including a CPU, a memory, and the like; and various electric components.

(1-3) Liquid-Side Connection Pipe L1, Gas-Side Connection Pipe G1

Each of the liquid-side connection pipe L1 and the gas-side connection pipe G1 is a refrigerant connection pipe for connecting the outdoor unit 10 to each of the indoor units 30, and is constructed on site. The pipe lengths and pipe diameters of the liquid-side connection pipe L1 and gas-side connection pipe G1 are appropriately selected in accordance with design specifications and installation environments.

(2) Flow of Refrigerant in Refrigerant Circuit RC

Next, a description will be given of the flow of the refrigerant in the refrigerant circuit RC. The air conditioning system 100 mainly performs a forward cycle operation and a reverse cycle operation. The low pressure in the refrigeration cycle is a pressure (a suction pressure) of the refrigerant sucked into the compressor 12, and the high pressure in the refrigeration cycle is a pressure (a discharge pressure) of the refrigerant discharged from the compressor 12.

(2-1) Flow of Refrigerant During Forward Cycle Operation

During the forward cycle operation (e.g., a cooling operation), the four-way switching valve 14 is in a forward cycle state (a state indicated by a solid line in the four-way switching valve 14 illustrated in FIG. 1). When the forward cycle operation is started, the refrigerant is sucked into and compressed by the compressor 12, and then is discharged from the compressor 12, in the outdoor-side circuit RC1. The compressor 12 is subjected to capacity control according to a heating load to be required for an indoor unit 30 under operation. Specifically, an operating frequency of the compressor 12 is controlled such that the suction pressure takes a target value set in accordance with the heating load to be required for the indoor unit 30. The gas refrigerant discharged from the compressor 12 flows into the outdoor heat exchanger 15.

When the gas refrigerant flows into the outdoor heat exchanger 15, the outdoor heat exchanger 15 causes the gas refrigerant to radiate heat by heat exchange with an outdoor air flow AF supplied by the outdoor fan 18, and then condenses the gas refrigerant. When the refrigerant flows out of the outdoor heat exchanger 15, then the refrigerant passes through the outdoor expansion valve 16. The outdoor expansion valve 16 decompresses the refrigerant or adjusts the flow rate of the refrigerant, in accordance with the opening degree of the outdoor expansion valve 16. The refrigerant then flows out of the outdoor-side circuit RC1. When the refrigerant flows out of the outdoor-side circuit RC1, then the refrigerant flows into the indoor-side circuit RC2 of the indoor unit 30 under operation, via the liquid-side connection pipe L1.

When the refrigerant flows into the indoor-side circuit RC2 of the indoor unit 30 under operation, then the refrigerant flows into the indoor expansion valve 31. The indoor expansion valve 31 decompresses the refrigerant to the low pressure in the refrigeration cycle, in accordance with the opening degree of the indoor expansion valve 31. The refrigerant then flows into the indoor heat exchanger 32. When the refrigerant flows into the indoor heat exchanger 32, the indoor heat exchanger 32 evaporates the refrigerant by heat exchange with an indoor air flow supplied by the indoor fan 33, thereby turning the refrigerant into the gas refrigerant. The gas refrigerant then flows out of the indoor heat exchanger 32. When the gas refrigerant flows out of the indoor heat exchanger 32, the gas refrigerant then flows out of the indoor-side circuit RC2.

When the refrigerant flows out of the indoor-side circuit RC2, then the refrigerant flows into the outdoor-side circuit RC1 via the gas-side connection pipe G1. When the refrigerant flows into the outdoor-side circuit RC1, then the refrigerant flows into the accumulator 11. When the refrigerant flows into the accumulator 11, then the refrigerant is temporarily stored in the accumulator 11. Thereafter, the refrigerant is sucked into the compressor 12 again.

(2-2) Flow of Refrigerant During Reverse Cycle Operation

During the reverse cycle operation (e.g., a heating operation), the four-way switching valve 14 is in a reverse cycle state (a state indicated by a broken line in the four-way switching valve 14 illustrated in FIG. 1). When the reverse cycle operation is started, the refrigerant is sucked into and compressed by the compressor 12, and then is discharged from the compressor 12, in the outdoor-side circuit RC1. As in the forward cycle operation, the compressor 12 is subjected to capacity control according to a heating load to be required for an indoor unit 30 under operation. When the gas refrigerant is discharged from the compressor 12, then the gas refrigerant flows out of the outdoor-side circuit RC1. The gas refrigerant then flows into the indoor-side circuit RC2 of the indoor unit 30 under operation, via the gas-side connection pipe G1.

When the refrigerant flows into the indoor-side circuit RC2, then the refrigerant flows into the indoor heat exchanger 32. The indoor heat exchanger 32 condenses the refrigerant by heat exchange with an indoor air flow supplied by the indoor fan 33. When the refrigerant flows out of the indoor heat exchanger 32, then the refrigerant flows into the indoor expansion valve 31. The indoor expansion valve 31 decompresses the refrigerant to the low pressure in the refrigeration cycle, in accordance with the opening degree of the indoor expansion valve 31. The refrigerant then flows out of the indoor-side circuit RC2.

When the refrigerant flows out of the indoor-side circuit RC2, then the refrigerant flows into the outdoor-side circuit RC1 via the liquid-side connection pipe L1. When the refrigerant flows into the outdoor-side circuit RC1, then the refrigerant flows into the outdoor heat exchanger 15 through a liquid-side port of the outdoor heat exchanger 15.

When the refrigerant flows into the outdoor heat exchanger 15, the outdoor heat exchanger 15 evaporates the refrigerant by heat exchange with an outdoor air flow AF supplied by the outdoor fan 18. When the refrigerant flows out of the outdoor heat exchanger 15 through a gas-side port of the outdoor heat exchanger 15, then the refrigerant flows into the accumulator 11. When the refrigerant flows into the accumulator 11, then the refrigerant is temporarily stored in the accumulator 11. Thereafter, the refrigerant is sucked into the compressor 12 again.

(3) Details of Outdoor Unit 10

Figure 2:
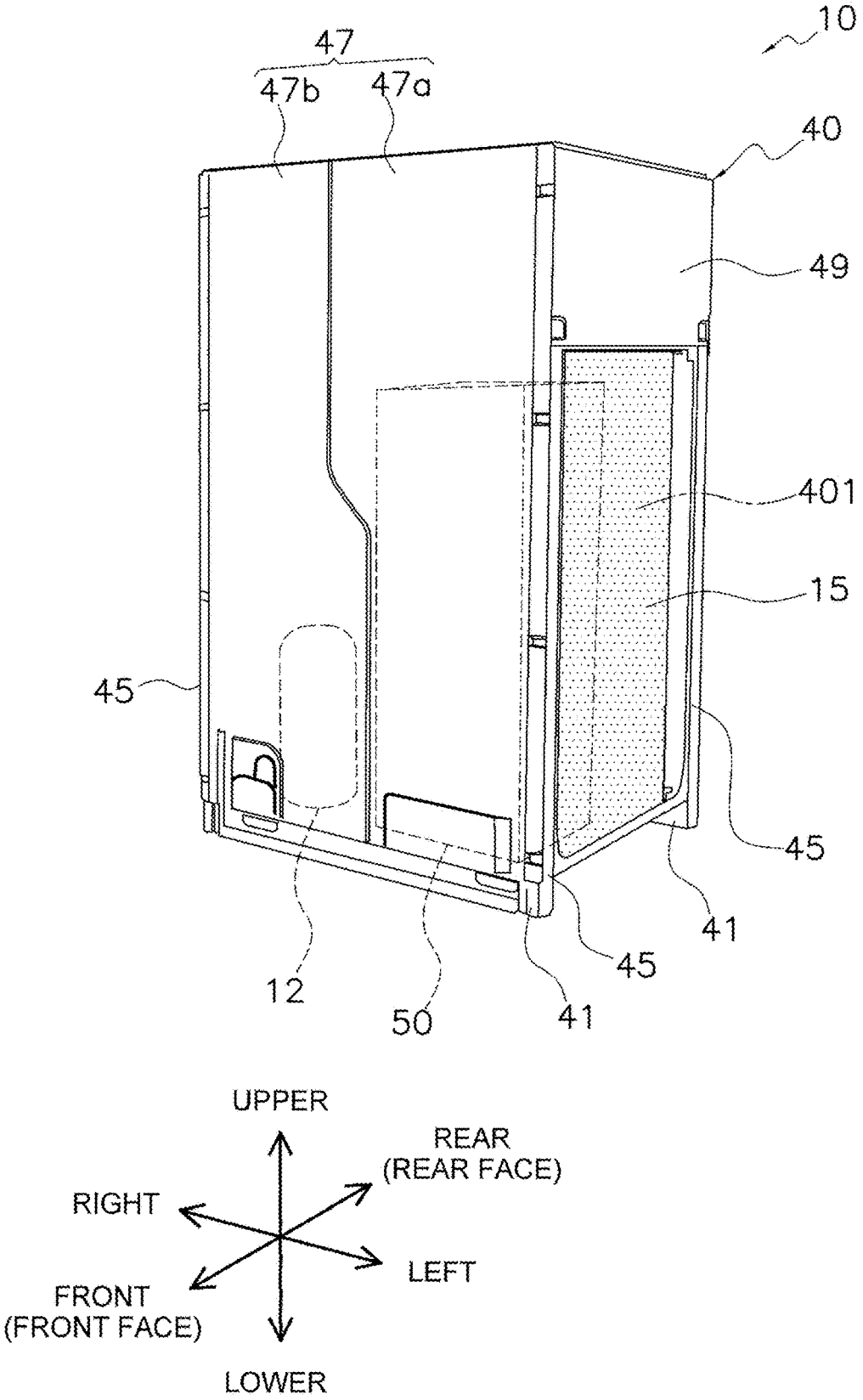
FIG. 2 is a front perspective view of the outdoor unit.
Figure 3:
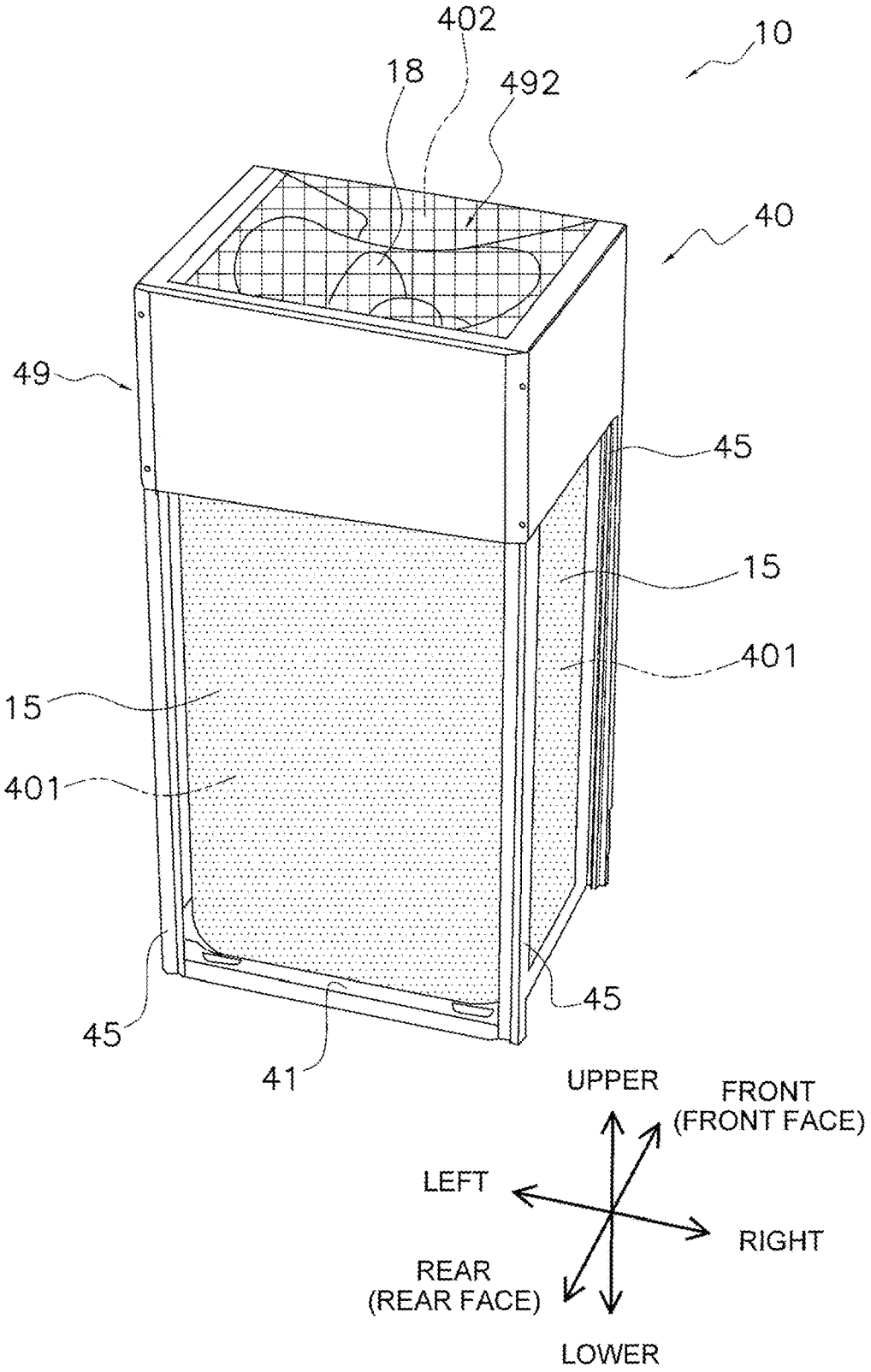
FIG. 3 is a rear perspective view of the outdoor unit.
Figure 4:
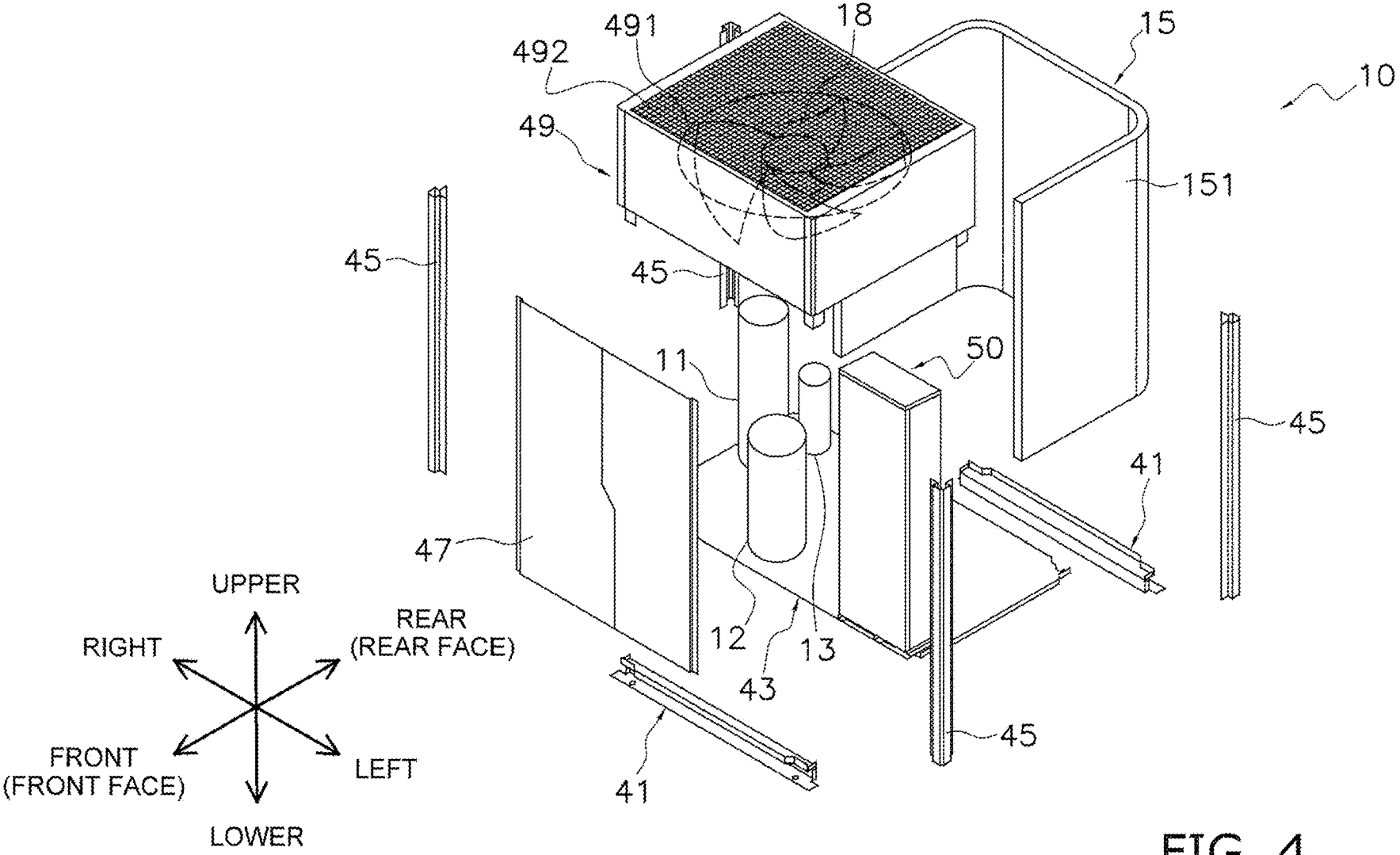
FIG. 4 is a schematic exploded view of the outdoor unit.

FIG. 2 is a front perspective view of the outdoor unit 10. FIG. 3 is a rear perspective view of the outdoor unit 10. FIG. 4 is a schematic exploded view of the outdoor unit 10.

(3-1) Outdoor Unit Casing 40

The outdoor unit 10 includes an outdoor unit casing 40 constituting an outer contour and housing therein the devices (e.g., 11, 12, 13, 14, 15, 16, 20). The outdoor unit casing 40 (which is an example of a "casing" in the claims) has substantially a parallelepiped shape, and includes an assembly of sheet metal members. The outdoor unit casing 40 has openings formed in its left side face, right side face, and rear face so as to mostly occupy the left side face, right side face, and rear face. These openings function as intake ports 401 through which outdoor air flows AF are sucked.

The outdoor unit casing 40 mainly includes a pair of installation legs 41, a bottom frame 43, a plurality of (four in this embodiment) supports 45, a front face panel 47, and a fan module 49.

Each of the installation legs 41 is a sheet metal member extending in the left-right direction and supporting the bottom frame 43 from below. The installation legs 41 are respectively located near a front end and a rear end of the outdoor unit casing 40.

The bottom frame 43 is a sheet metal member constituting a bottom face portion of the outdoor unit casing 40. The bottom frame 43 is disposed on the pair of installation legs 41. The bottom frame 43 has substantially a rectangular shape in plan view.

The supports 45 extend vertically from corner portions of the bottom frame 43, respectively. As illustrated in FIGS. 2 to 4, the supports 45 extend vertically from the four corner portions of the bottom frame 43, respectively.

The front face panel 47 is a sheet metal member constituting a front face portion of the outdoor unit casing 40. More specifically, the front face panel 47 includes a first front face panel 47*a* and a second front face panel 47*b*. The first front face panel 47*a* constitutes a left side of the front face portion of the outdoor unit casing 40. The second front face panel 47*b* constitutes a right side of the front face portion of the outdoor unit casing 40. The first front face panel 47*a* and the second front face panel 47*b* are positioned with respect to the outdoor unit casing 40. The first front face panel 47*a* and the second front face panel 47*b* are then fastened to the supports 45 with screws. The first front face panel 47*a* and the second front face panel 47*b* are thus secured to the supports 45 independently of each other.

The fan module 49 is mounted to the supports 45 at a position near upper ends of the supports 45. The fan module 49 constitutes portions of a front face, the rear face, the left side face, and the right side face of the outdoor unit casing 40, the portions being located above the supports 45, and a top face of the outdoor unit casing 40. The fan module 49 includes the outdoor fan 18 and a bell mouth 491. More specifically, the fan module 49 is an aggregate of the outdoor fan 18 and bell mouth 491 housed in substantially a parallelepiped box whose upper and lower faces are opened. In the fan module 49, the outdoor fan 18 is disposed such that its axis extends vertically. The fan module 49 has an opened upper face portion that functions as a blow-out port 402 through which an outdoor air flow AF is blown out of the outdoor unit casing 40. A grid-shaped grille 492 is disposed on the blow-out port 402.

Figure 5:
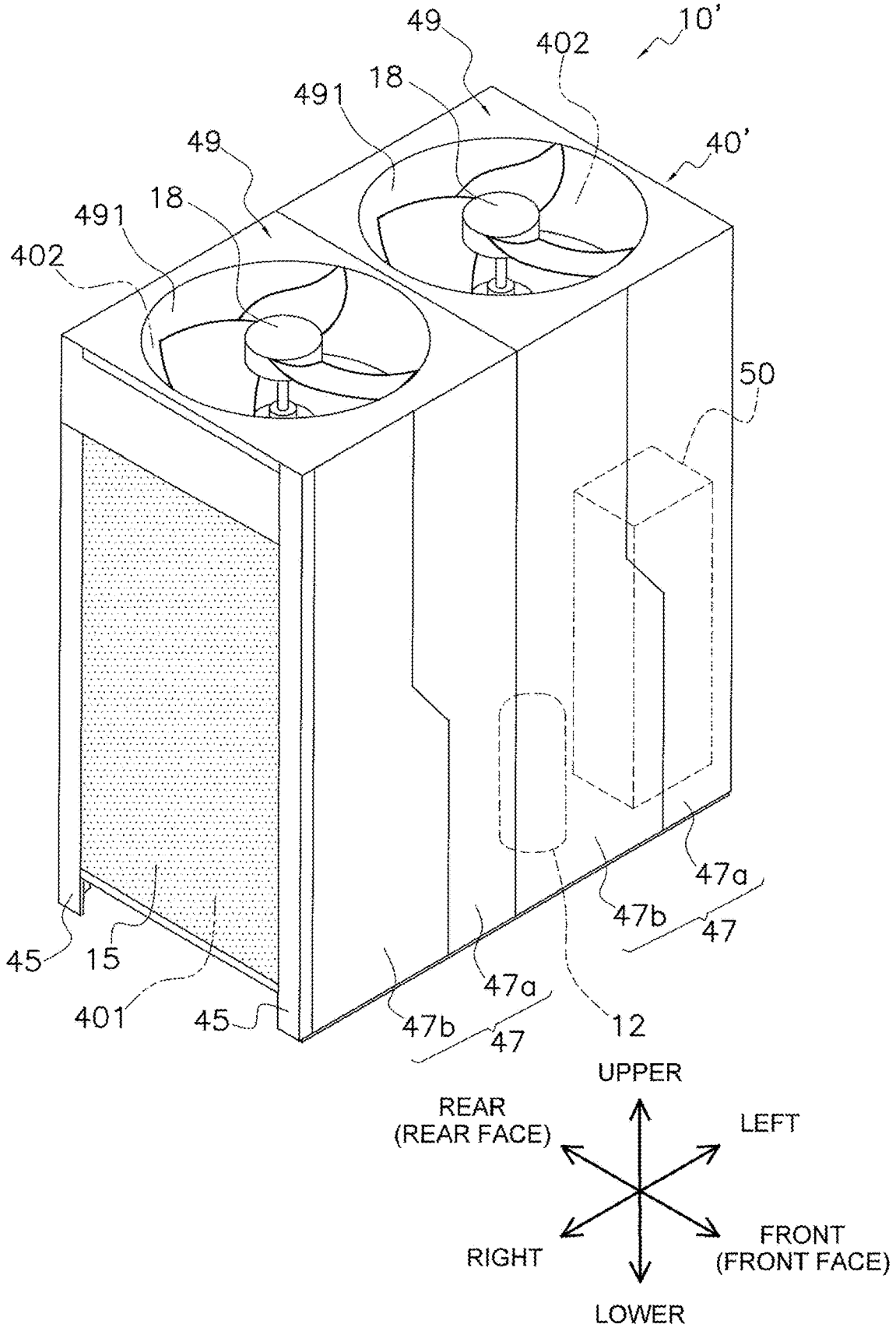
FIG. 5 is a perspective view of an exemplary outdoor unit including two fan modules.

As illustrated in FIGS. 2 to 4, the outdoor unit 10 includes one fan module 49. Alternatively, the outdoor unit 10 may include a plurality of fan modules 49. As illustrated in FIG. 5, for example, an outdoor unit 10' may include two fan modules 49. In the outdoor unit 10' illustrated in FIG. 5, the two fan modules 49 are arranged side by side in the left-right direction. The outdoor unit 10' includes an outdoor unit casing 40' that is larger in dimensions than the outdoor unit casing 40 of the outdoor unit 10 including one fan module 49. The outdoor unit casing 40' includes two front face panels 47 arranged side by side in the left-right direction. Although not illustrated in the drawings, an outdoor heat exchanger 15 of the outdoor unit 10' is larger in dimensions than the outdoor heat exchanger 15 of the outdoor unit 10, in accordance with the dimensions of the outdoor unit casing 40'.

(3-2) Layout of Devices on Bottom Frame 43

Figure 6:
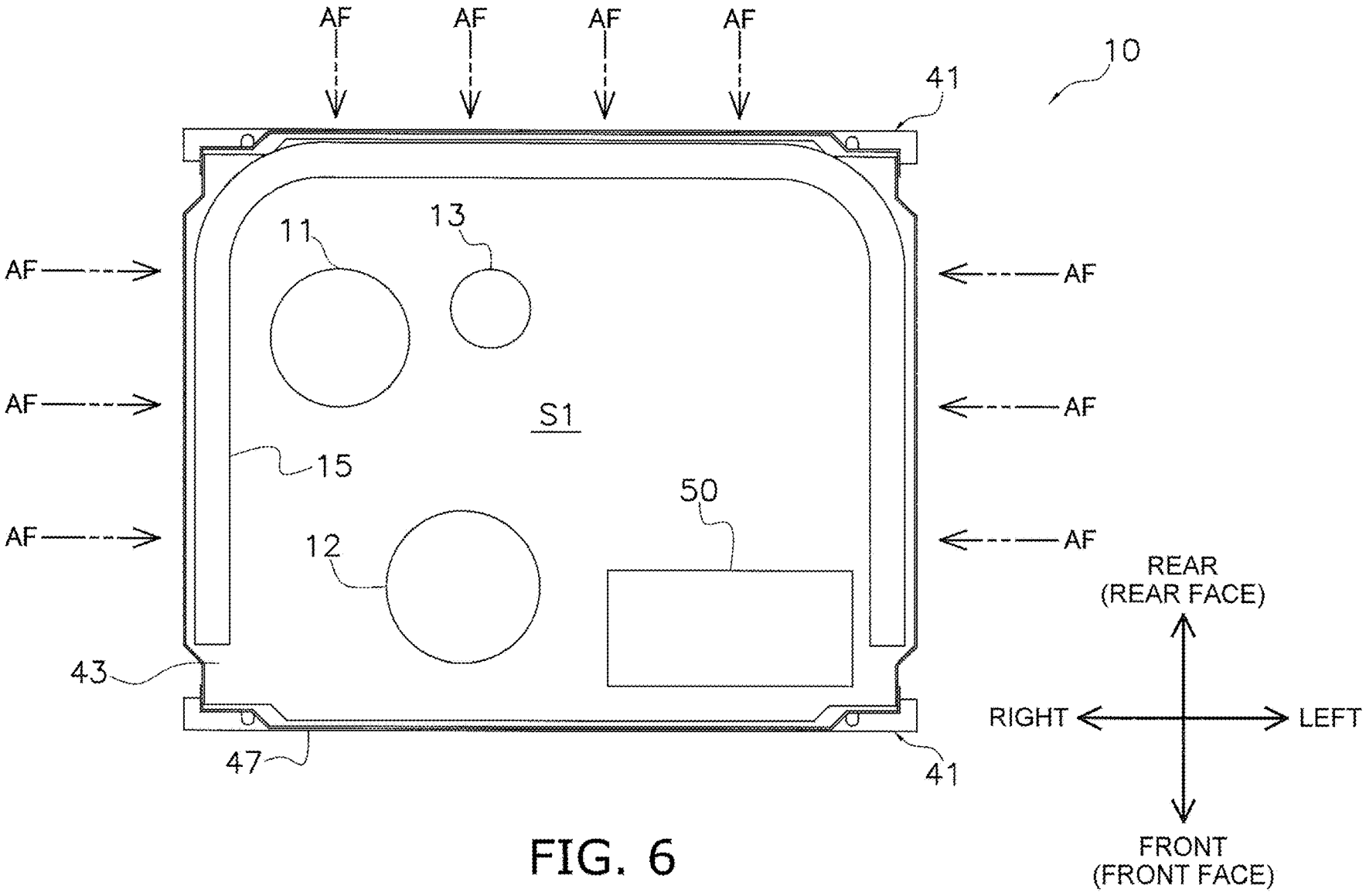
FIG. 6 is a schematic view of a layout of devices on a bottom frame and directions of outdoor air flows.

FIG. 6 is a schematic view of a layout of the devices on the bottom frame 43 and directions of outdoor air flows AF. As illustrated in FIG. 6, various devices, including the accumulator 11, the compressor 12, the oil separator 13, and the outdoor heat exchanger 15, are disposed at predetermined positions on the bottom frame 43. In addition, the electric component box 50 housing therein the outdoor unit control unit 20 is disposed on the bottom frame 43.

The outdoor heat exchanger 15 has heat exchange faces 151 (see FIG. 4) respectively extending along the left side face, right side face, and rear face of the outdoor unit casing 40. The heat exchange faces 151 are substantially equal in height to the intake ports 401. The intake ports 401 mostly occupy the rear face, left side face, and right side face of the outdoor unit casing 40. The heat exchange faces 151 of the outdoor heat exchanger 15 are respectively exposed from the intake ports 401. In other words, the rear face, left side face, and right side face of the outdoor unit casing 40 are substantially formed of the heat exchange faces 151 of the outdoor heat exchanger 15. The outdoor heat exchanger 15 has three heat exchange faces 151. In this regard, the outdoor heat exchanger 15 has left and right curved portions in plan view. In other words, the outdoor heat exchanger 15 has substantially a U shape opened toward the front face.

The accumulator 11 is disposed on a left forward side of the right curved portion of the outdoor heat exchanger 15 and a right rearward side of the compressor 12.

The compressor 12 is disposed on a left side of a right-side end of the outdoor heat exchanger 15 and a left forward side of the accumulator 11. The compressor 12 is located on the right side of the front face portion of the outdoor unit casing 40. The compressor 12 is located below the fan module 49 (the outdoor fan 18). In other words, the outdoor fan 18 is higher in heightwise position than the compressor 12.

The oil separator 13 is disposed on a left side of the accumulator 11.

Figure 7:
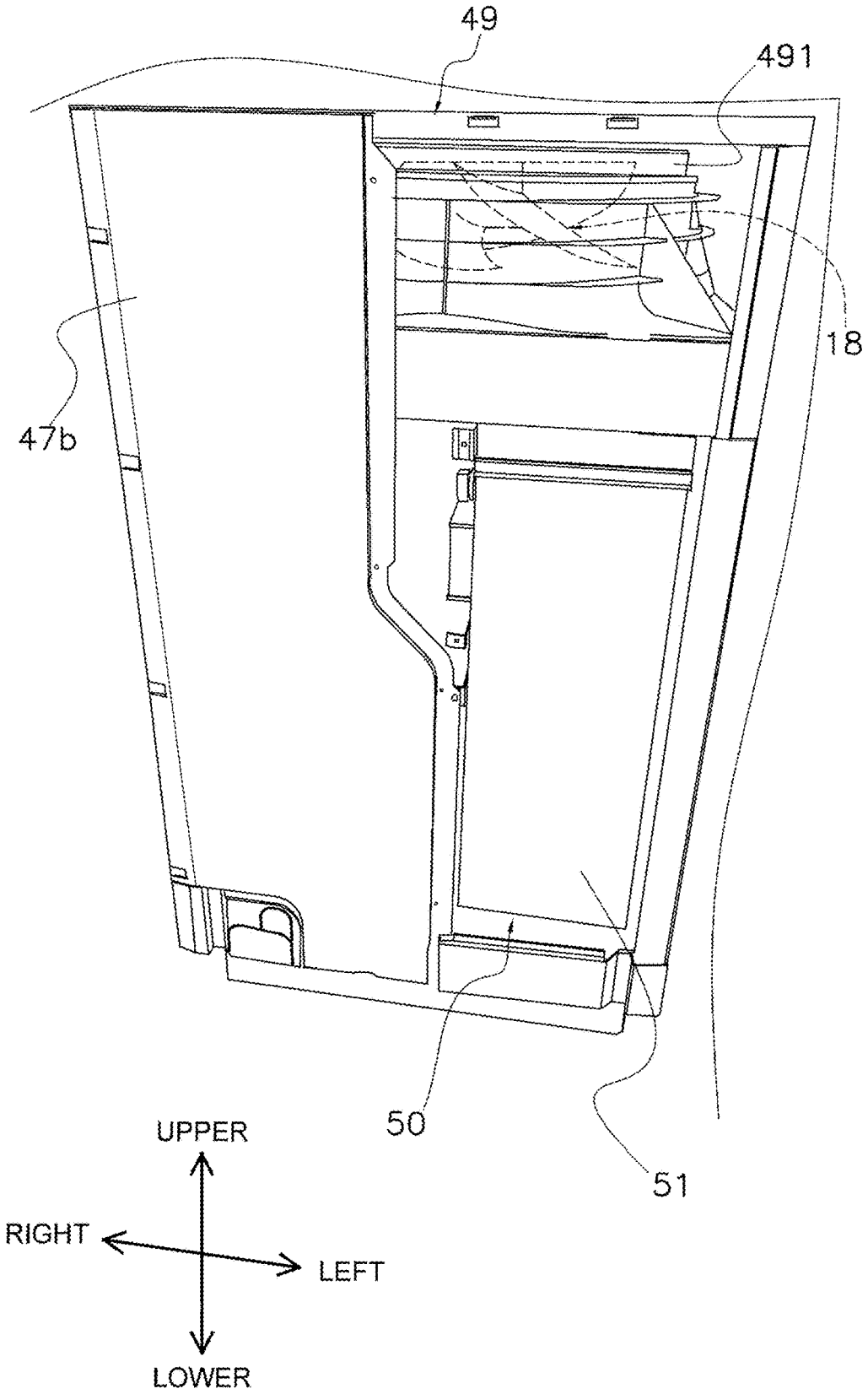
FIG. 7 is a front enlarged view of the outdoor unit from which a first front face panel is detached.

As illustrated in FIGS. 2 and 4 to 6, the electric component box 50 (which is an example of an "electric component box" in the claims) is disposed on a right side of a left-side end of the outdoor heat exchanger 15 and a left side of the compressor 12. The electric component box 50 is located on the left side of the front face portion of the outdoor unit casing 40. FIG. 7 is a front enlarged view of the outdoor unit 10 from which the first front face panel 47*a* is detached. As illustrated in FIG. 7, the electric component box 50 is exposed from the front face of the outdoor unit 10 in the state in which the first front face panel 47*a* is detached from the outdoor unit 10. The electric component box 50 is thus accessible only by detaching the first front face panel 47*a* without detaching the second front face panel 47*b*. The electric component box 50 includes a front face cover 51 constituting the front face portion. A specific description on the electric component box 50 will be given later.

(3-3) Outdoor Air Flows AF in Outdoor Unit Casing 40

Figure 8:
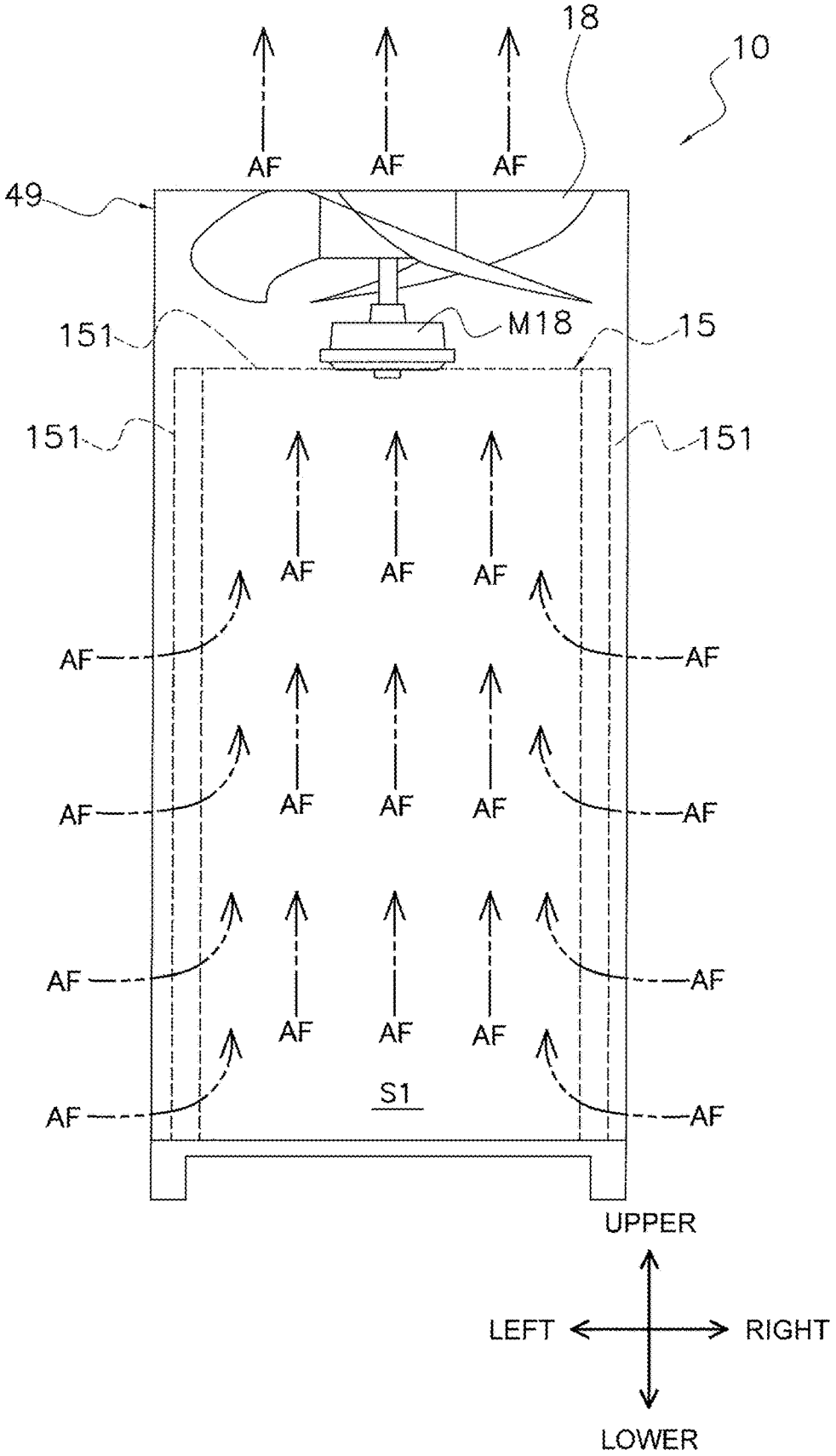
FIG. 8 is a schematic view of outdoor air flows in an outdoor unit casing.

FIG. 8 is a schematic view of outdoor air flows AF in the outdoor unit casing 40. As illustrated in FIGS. 6 and 8, outdoor air flows AF flow into the outdoor unit casing 40 through the intake ports 401 in the left side face, right side face, and rear face of the outdoor unit casing 40, and pass through the outdoor heat exchanger 15 (the heat exchange faces 151). The outdoor air flows AF then mainly flow from below upward to flow out of the outdoor unit casing 40 through the blow-out port 402. Specifically, the outdoor air flows AF flow horizontally into the outdoor unit casing 40 through the intake ports 401, pass through the outdoor heat exchanger 15, turn upward, and flow from below upward toward the blow-out port 402.

In the following description, a space, where main flow paths of outdoor air flows AF are formed, in the outdoor unit casing 40 (a space surrounded with the outdoor heat exchanger 15 and the front face panel 47 in FIG. 6) is referred to as an "air blowing space 51".

(4) Details of Electric Component Box 50

Figure 9:
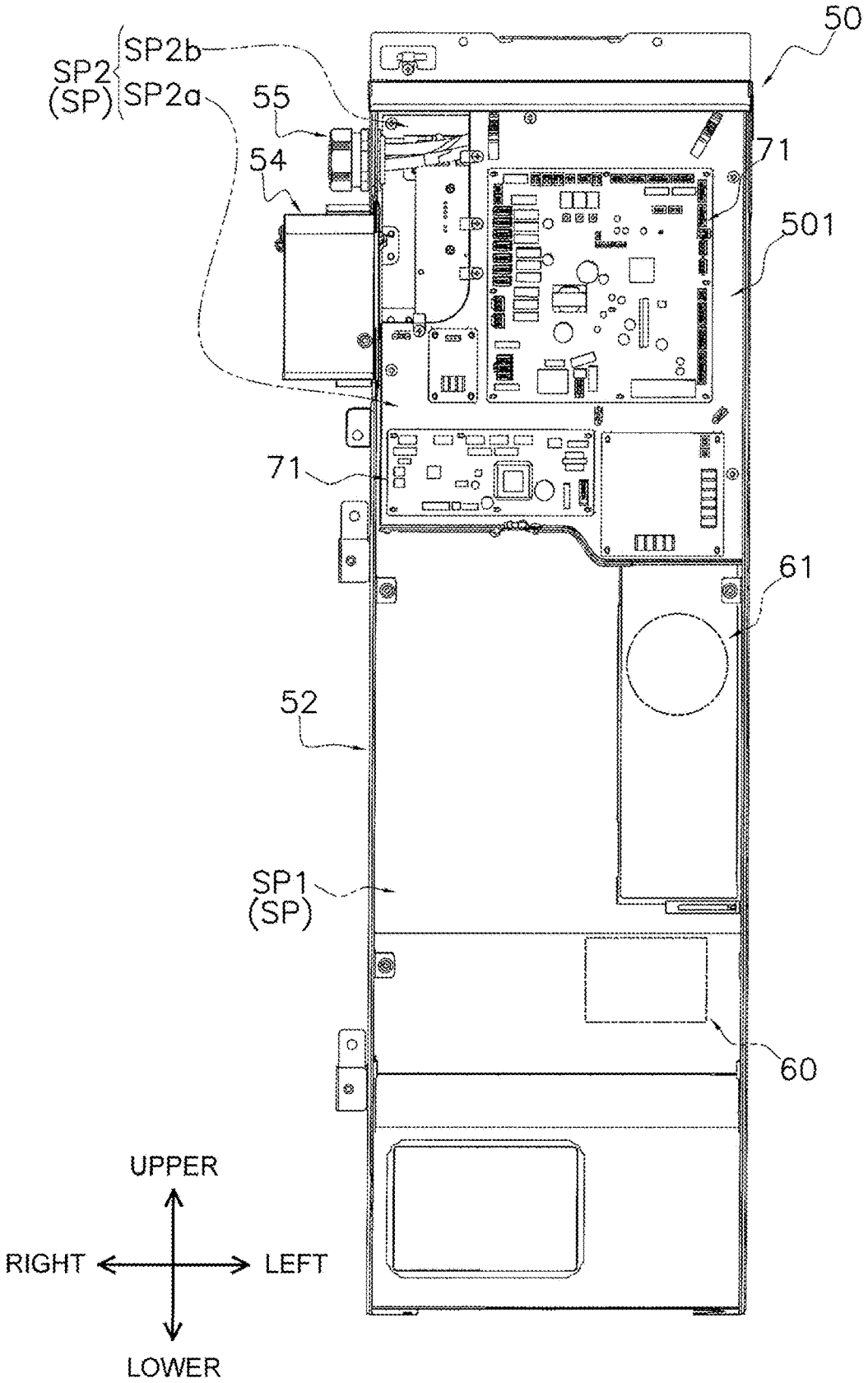
FIG. 9 is a front view of an electric component box from which a front face cover is detached.
Figure 10:
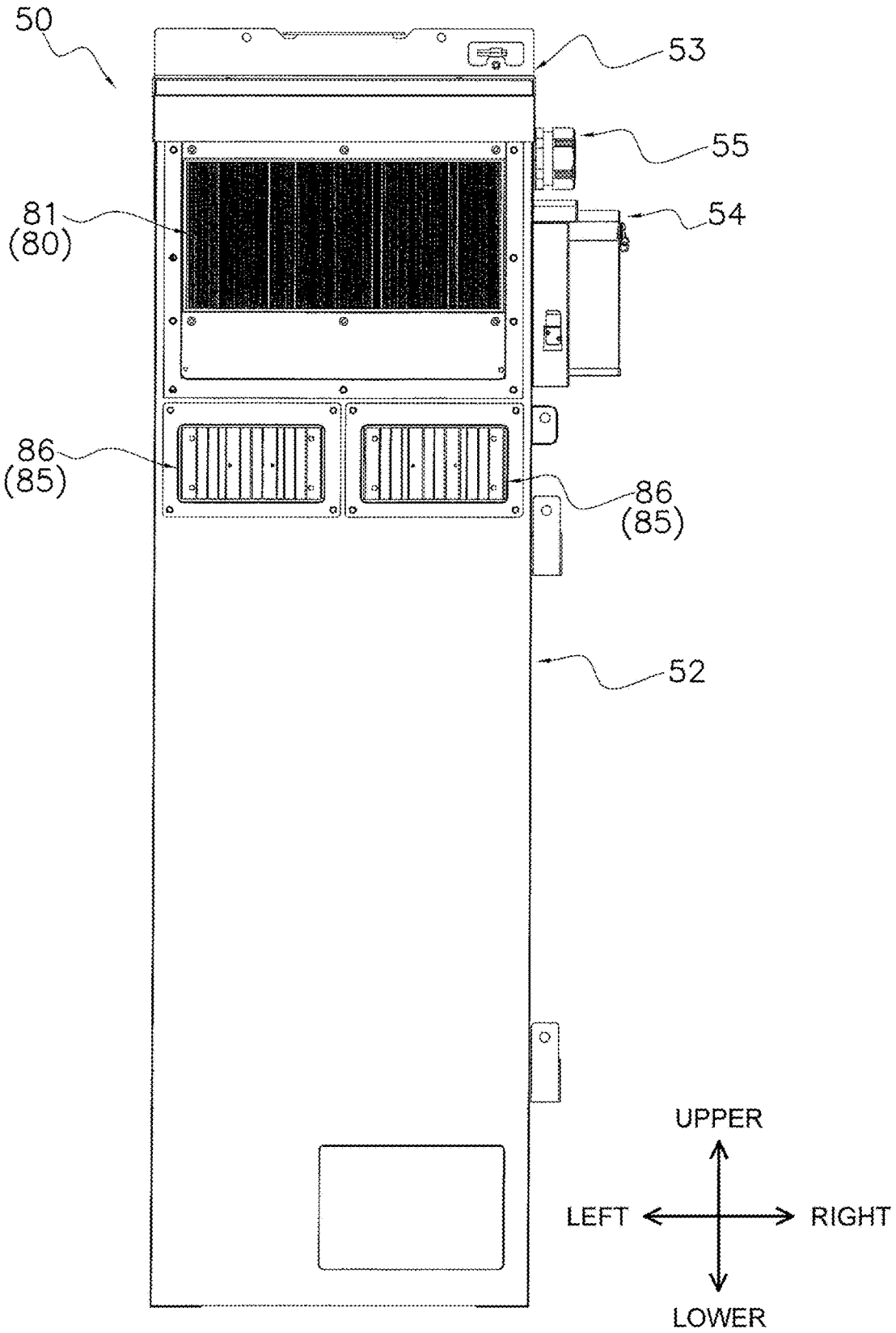
FIG. 10 is a rear view of the electric component box illustrated in FIG. 9.
Figure 11:
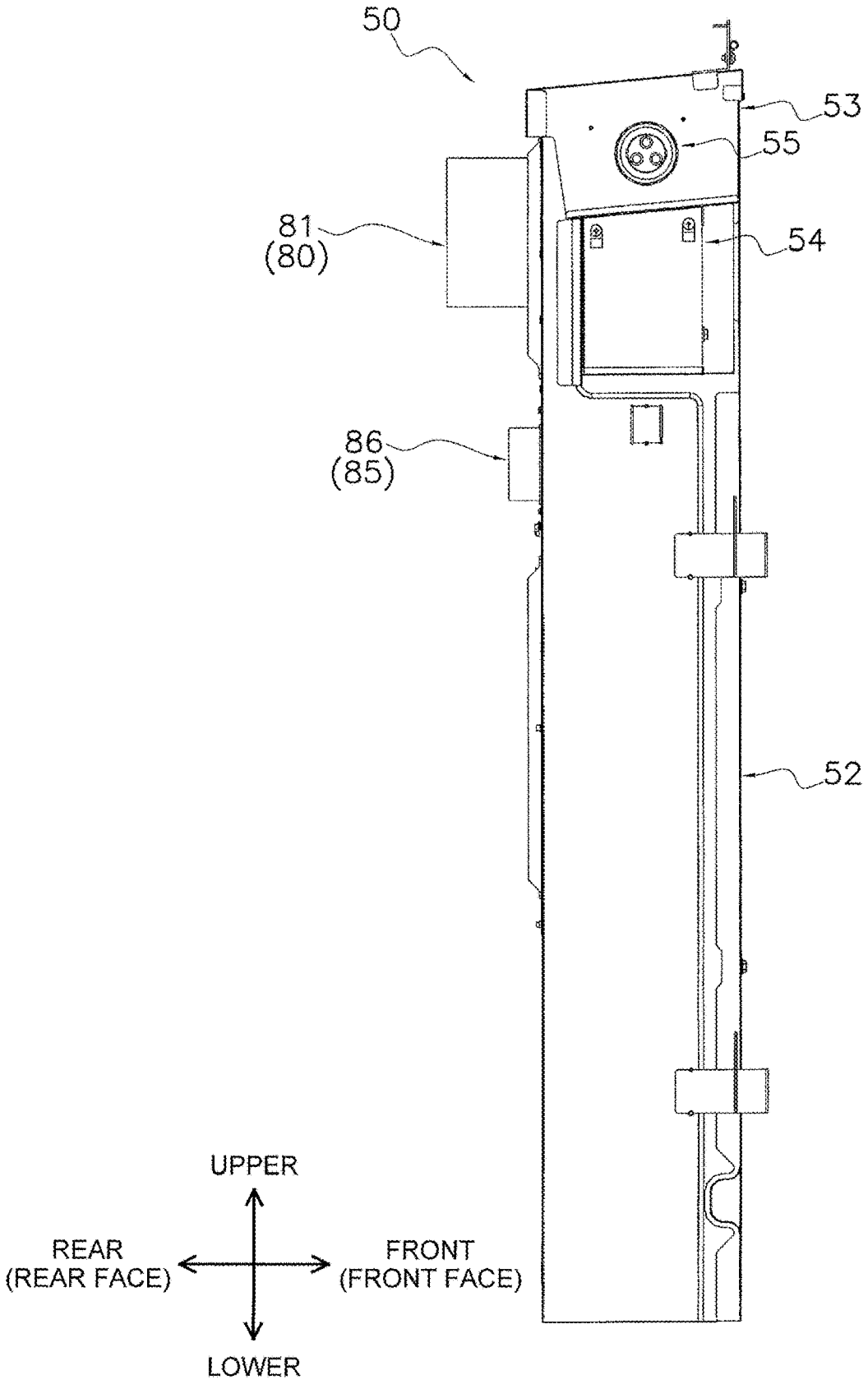
FIG. 11 is a right side view of the electric component box illustrated in FIG. 9.

FIG. 9 is a front view of the electric component box 50 from which the front face cover 51 is detached. FIG. 10 is a rear view of the electric component box 50 illustrated in FIG. 9. FIG. 11 is a right side view of the electric component box 50 illustrated in FIG. 9.

(4-1) Space in Electric Component Box 50 and Layout of Devices in Electric Component Box The electric component box 50 is substantially a parallelepiped box which is made of metal and of which a length in the height direction (the upper-lower direction in this embodiment) is longer than a length in the width direction (the left-right direction in this embodiment) and a length in the depth direction (the front-rear direction in this embodiment). Various components constituting the outdoor unit control unit 20 are accommodated in a space defined in the electric component box 50 (hereinafter, referred to as an "inner space SP").

The inner space SP includes a lower space SP1 and an upper space SP2 located above the lower space SP1. The lower space SP1 and the upper space SP2 communicate with each other without being separated from each other, and there is no clear boundary between them.

The lower space SP1 extends from a lower end of the inner space SP (a bottom face portion of the electric component box 50) by a predetermined heightwise length (a length that is about substantially two-thirds of a heightwise length of the inner space SP). Electric components such as a terminal block 60 and a reactor 61 are disposed in the lower space SP1.

The upper space SP2 extends from an upper end of the lower space SP1 to an upper end of the inner space SP (a top face portion of the electric component box 50). A vertical plate 501 is disposed in the upper space SP2 to partition the upper space SP2 into two spaces in the depth direction (the front-rear direction). The vertical plate 501 is a metal sheet extending vertically. The vertical plate 501 partitions the upper space SP2 into a front-side upper space SP2*a* and a rear-side upper space SP2*b* located on a rear face side of the front-side upper space SP2*a*. The front-side upper space SP2*a* and the rear-side upper space SP2*b* are arranged in the depth direction of the electric component box 50.

A plurality of (two in this embodiment) control boards 71 are accommodated in the front-side upper space SP2*a*. On each control board 71, a microcomputer including a CPU, various memories, and the like and a communication module are mounted. The control boards 71 are fixed to a front face portion of the vertical plate 501. Each of the control boards 71 is fixed to the vertical plate 501 such that a main surface thereof is directed to the front face (i.e., each control board 71 is thick in the front-rear direction).

Figure 12:
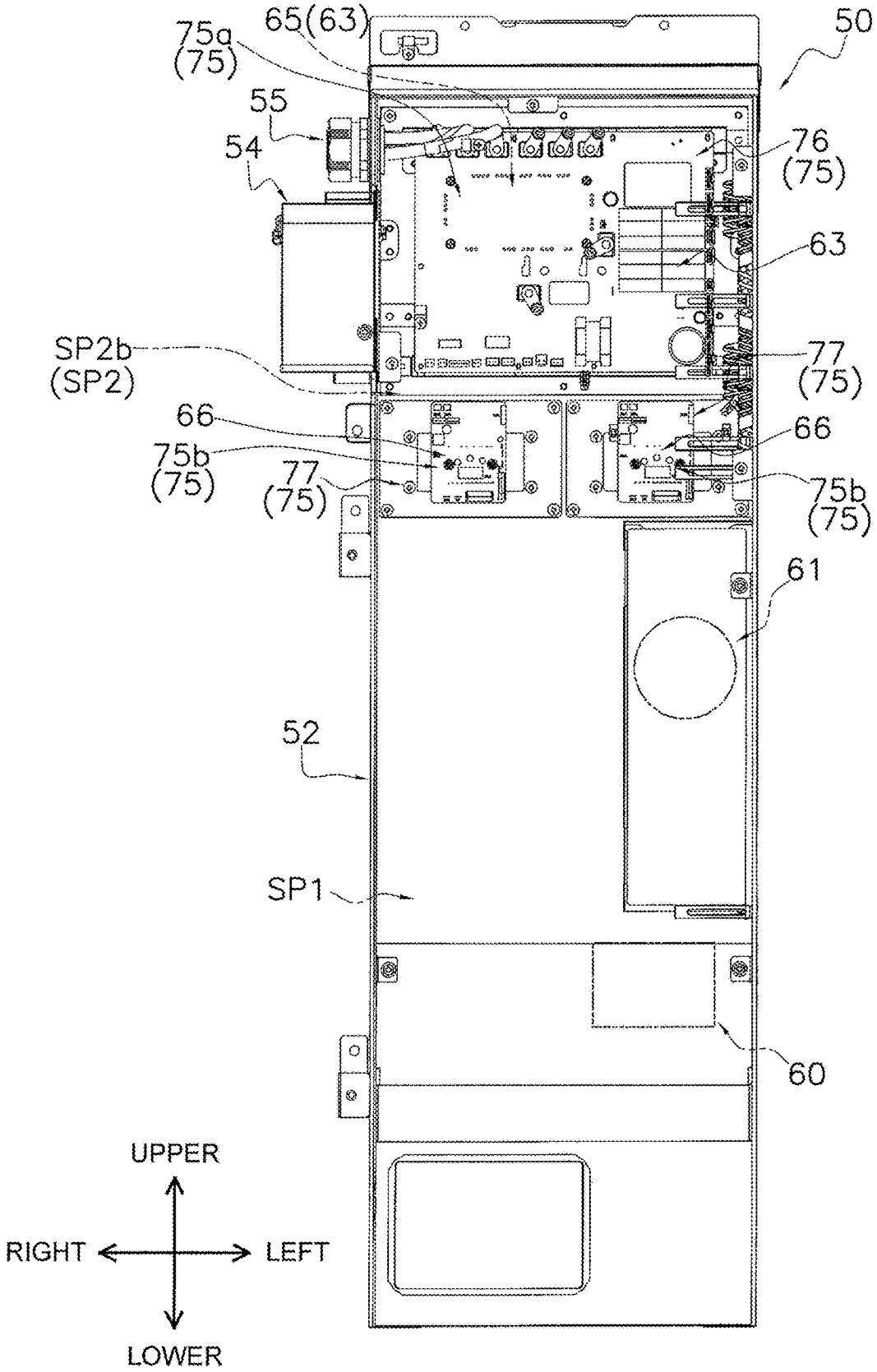
FIG. 12 is a front view of the electric component box from which a vertical plate (a control board) is detached.
Figure 13:
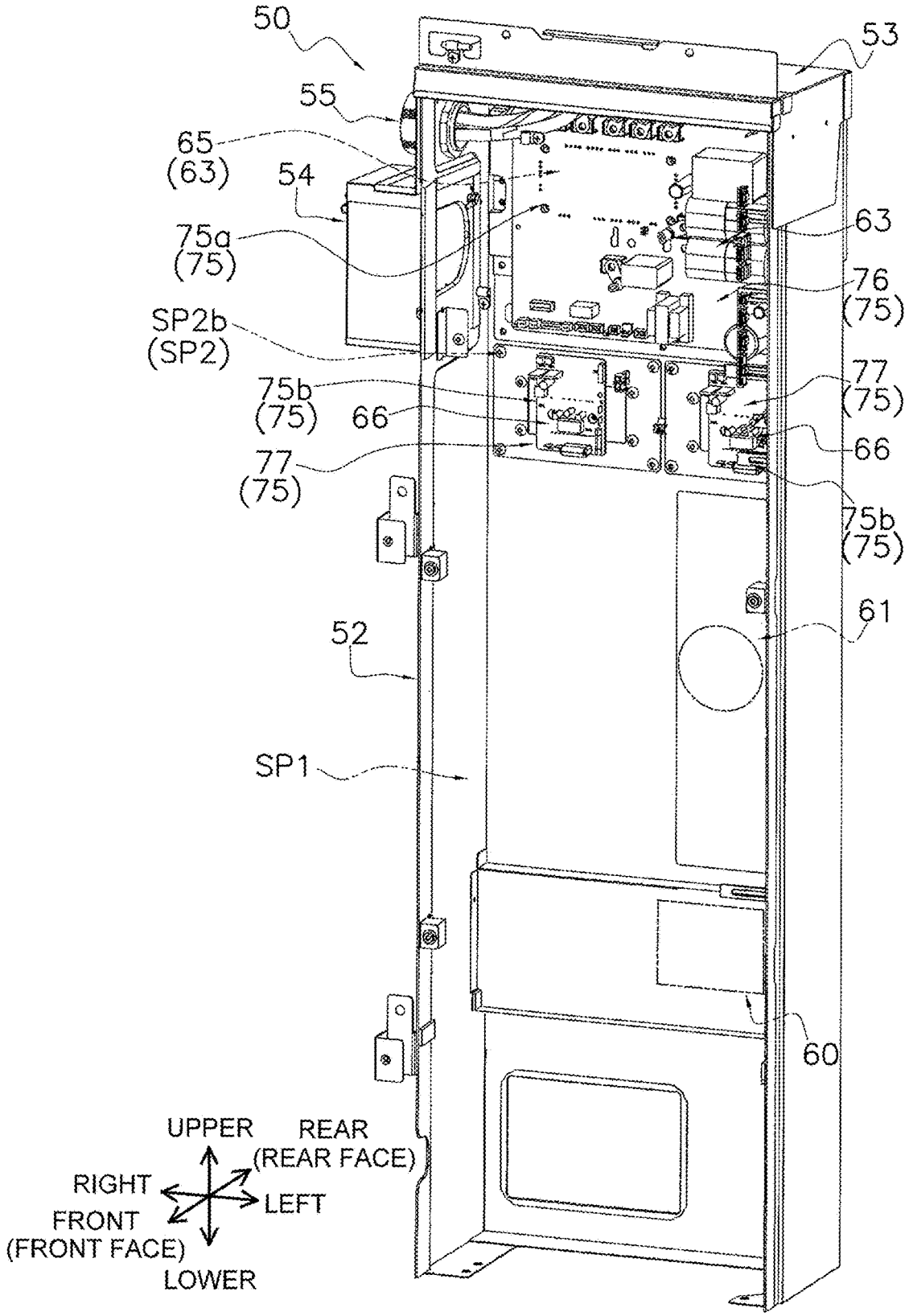
FIG. 13 is a front perspective view of the electric component box illustrated in FIG. 12.

FIG. 12 is a front view of the electric component box 50 from which the vertical plate 501 (the control boards 71) is detached. FIG. 13 is a front perspective view of the electric component box 50 illustrated in FIG. 12.

Aboard unit 75 (which is an example of a "board part" in the claims) is accommodated in the rear-side upper space SP2*b*. On the board unit 75, various electric components are mounted for controlling driven states of the actuators disposed in the outdoor unit 10. Specifically, the board unit 75 includes: a compressor controlling electric component mount portion 75*a* (which is an example of a "first portion" in the claims) on which electric components for inverter-controlling the compressor 12 (hereinafter, referred to as "compressor controlling electric components 63" are mounted; and fan controlling electric component mount portions 75*b* (each of which is an example of a "second portion" in the claims) on which electric components for controlling driven states of the outdoor fans 18 (hereinafter, referred to as "fan controlling electric components 66") are mounted.

In this embodiment, the compressor controlling electric components 63 are mounted on a compressor control board 76 (which is an example of a "first board" in the claims) that is a part of the board unit 75. In this embodiment, in other words, the compressor controlling electric component mount portion 75*a* is disposed on the compressor control board 76. In addition, the fan controlling electric components 66 are mounted on fan control boards 77 (each of which is an example of a "second board" in the claims). Each of the fan control boards 77 is a part of the board unit 75. In this embodiment, in other words, the fan controlling electric component mount portions 75*b* are respectively disposed on the fan control boards 77.

Figure 25:
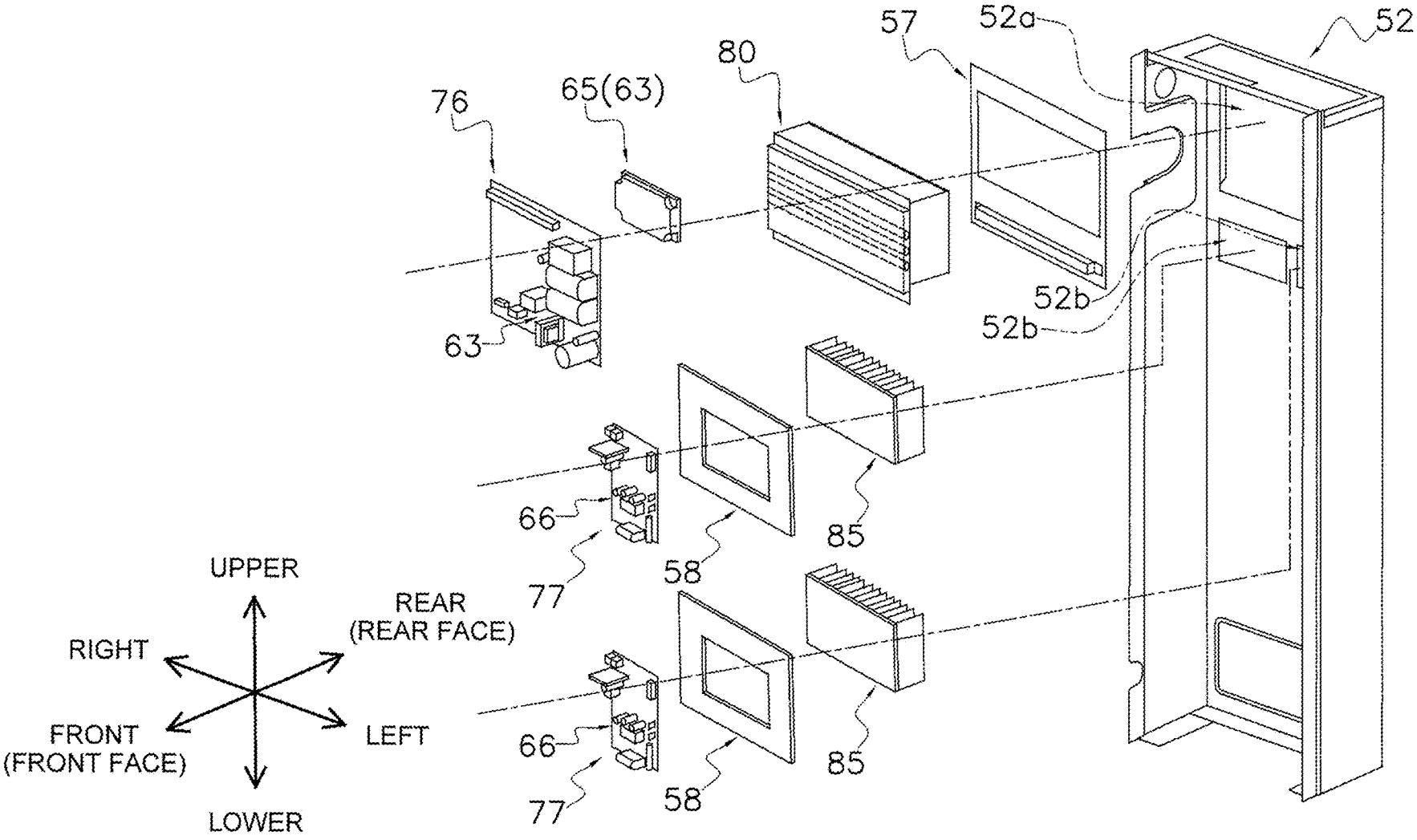
FIG. 25 is a schematic view about how a compressor control board, a fan control board, the first cooling unit, and the second cooling unit are fixed to the main body frame.
Figure 26:
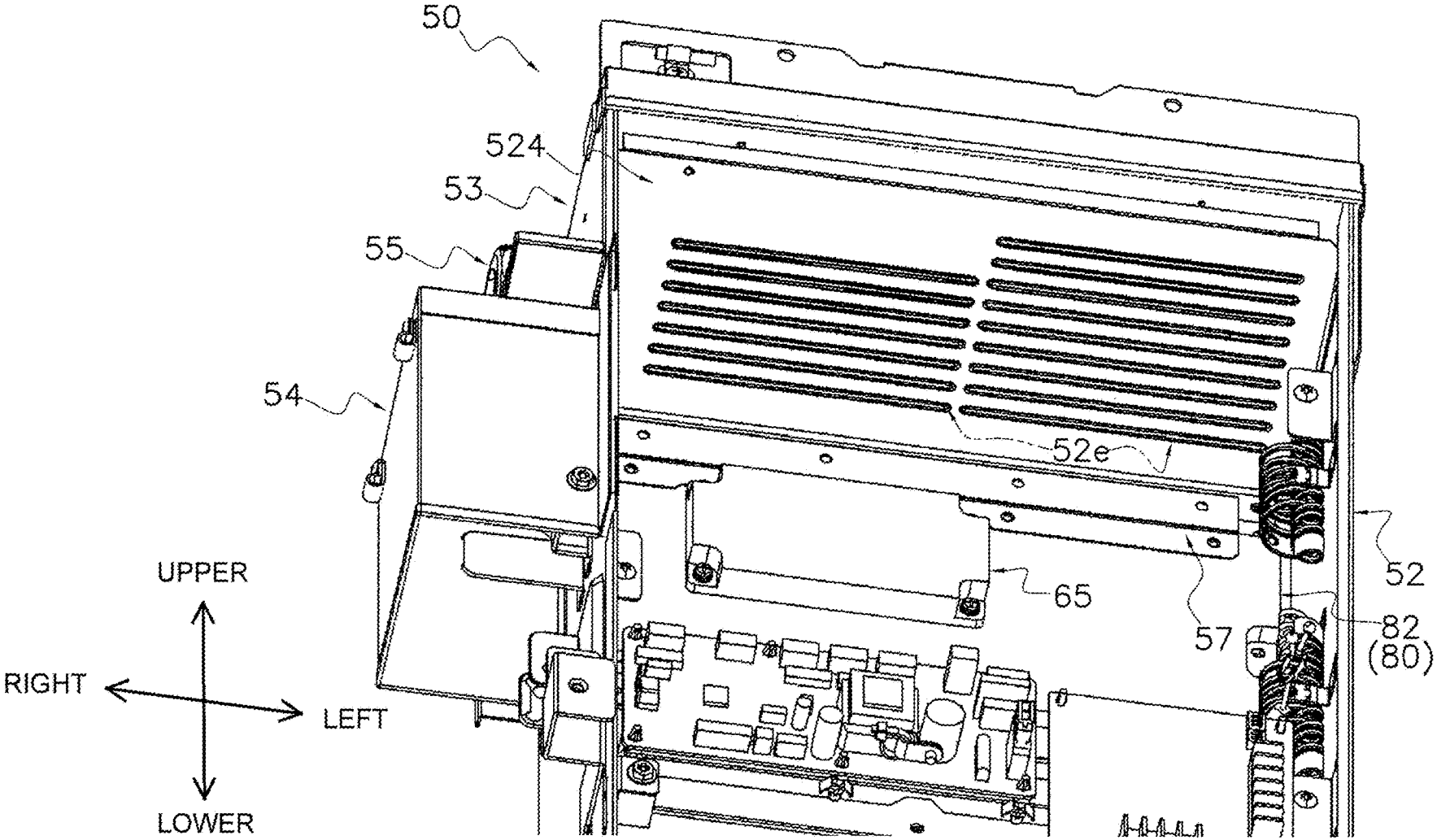
FIG. 26 is a front perspective view of a high-heat generating electric component (a power module) fixed to the first cooling unit.

The compressor controlling electric components 63 include an electric component configured to generate heat when being energized. Examples of the compressor controlling electric components 63 include a smoothing capacitor, a diode bridge, and the like to be mounted on a front-side main surface of the compressor control board 76. The compressor controlling electric components 63 also include an electric component that is considerably larger in heating value upon energization than the other electric components (hereinafter, such an electric component is referred to as a "high-heat generating electric component 65"). Examples of the high-heat generating electric component 65 (which is an example of a "first electric component" in the claims) include various electric components (e.g., power devices including a switching element, such as an insulated gate bipolar transistor (IGBT)) constituting an inverter. As illustrated in FIGS. 25 and 26, more specifically, a power module including a plurality of (six in this embodiment) integrated power devices is mounted as the high-heat generating electric component 65 on the compressor control board 76 (the compressor controlling electric component mount portion 75*a*). The high-heat generating electric component 65 (the power module) is mounted on a rear-side main surface of the compressor control board 76. The power module is particularly larger in heating value upon energization than the other electric components. The power module is, for example, an intelligent power module (IPM) including a plurality of power devices. In the state in which the electric component box 50 is disposed in the outdoor unit casing 40, the high-heat generating electric component 65 is lower in heightwise position than the outdoor fans 18 and higher in heightwise position than the fan controlling electric components 66.

The fan controlling electric components 66 (each of which is an example of a "second electric component" in the claims) include an electric component configured to generate heat when being energized. Examples of the fan controlling electric components 66 include a capacitor, a diode, and a switch such as a relay. In FIGS. 12 and 13, on the assumption that the outdoor unit 10 includes two outdoor fans 18 (e.g., the outdoor unit 10' illustrated in FIG. 5), two fan control boards 77 (two fan controlling electric component mount portions 75*b*) are arranged side by side in the left-right direction in the rear-side upper space SP2*b* in one-to-one correspondence with the outdoor fans 18. The fan controlling electric components 66 are smaller in heating value upon energization than the high-heat generating electric component 65.

In the rear-side upper space SP2*b*, a first cooling unit 80 for cooling the compressor controlling electric components 63 (mainly, the high-heat generating electric component 65) mounted on the compressor control board 76 is disposed on a rear face side of the compressor control board 76. A specific description on the first cooling unit 80 will be given later.

Also in the rear-side upper space SP2*b*, second cooling units 85 are disposed for cooling the fan controlling electric components 66 mounted on the fan control boards 77. More specifically, the second cooling units 85 disposed in the rear-side upper space SP2*b* are equal in number (two in this embodiment) to the fan control boards 77. The second cooling units 85 are in one-to-one correspondence with the fan control boards 77. Each of the second cooling units 85 is disposed on a rear face side of the corresponding fan control board 77. A specific description on the second cooling units 85 will be given later.

(4-2) Configuration of Electric Component Box 50

Figure 17:
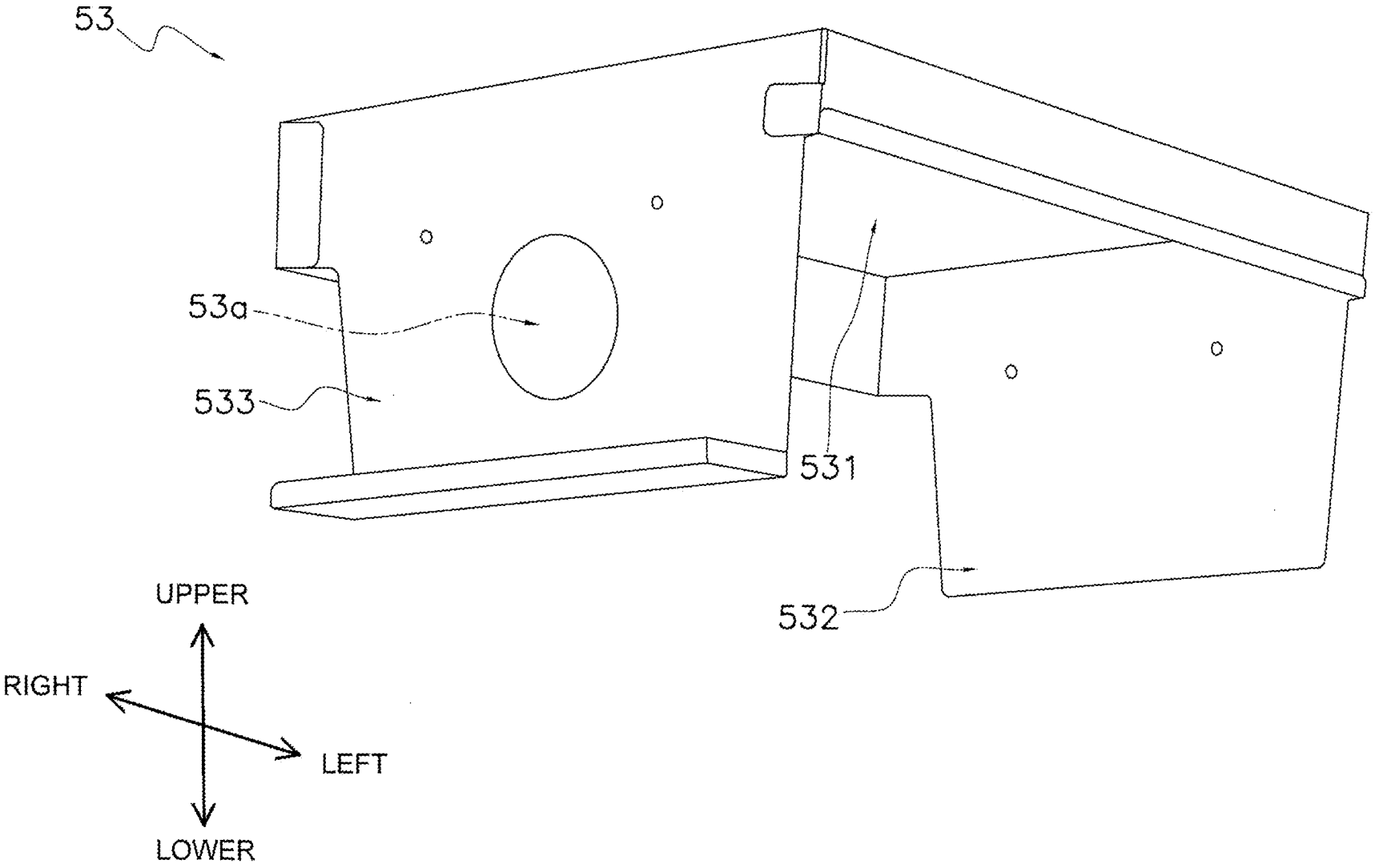
FIG. 17 is a perspective view of the top face cover.
Figure 18:
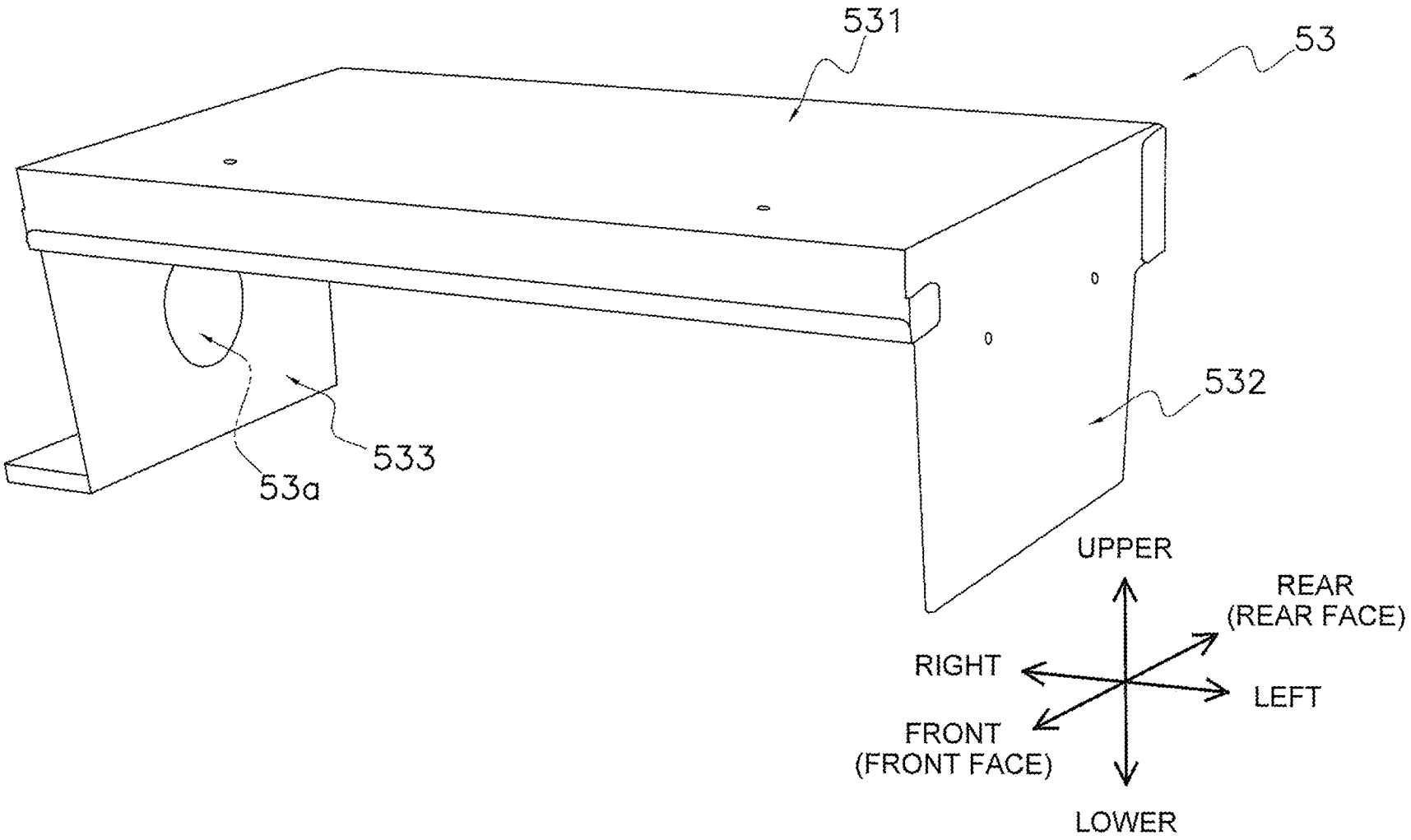
FIG. 18 is a perspective view of the top face cover seen from an angle different from that in FIG. 17.

The electric component box 50 includes as its constituent members the front face cover 51 (see FIG. 7), a main body frame 52 (see FIGS. 14 and 15), and a top face cover 53 (see FIGS. 17 and 18).

(4-2-1) Front Face Cover 51

The front face cover 51 is substantially a rectangular plate-shaped member constituting a front face portion of the electric component box 50. The front face cover 51 is substantially equal in widthwise length and heightwise length to the electric component box 50.

(4-2-2) Main Body Frame 52

Figure 14:
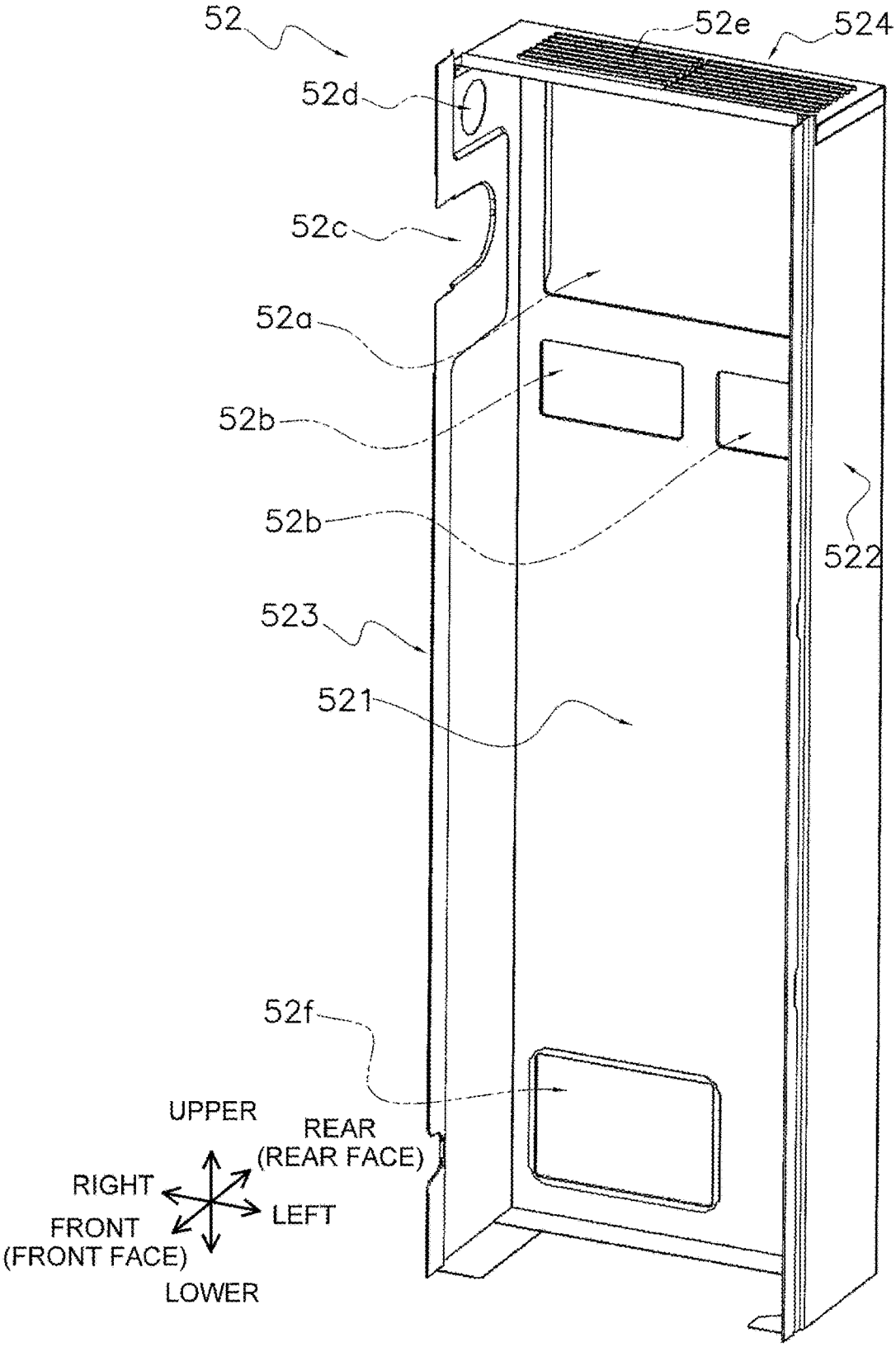
FIG. 14 is a front perspective view of a main body frame.
Figure 15:
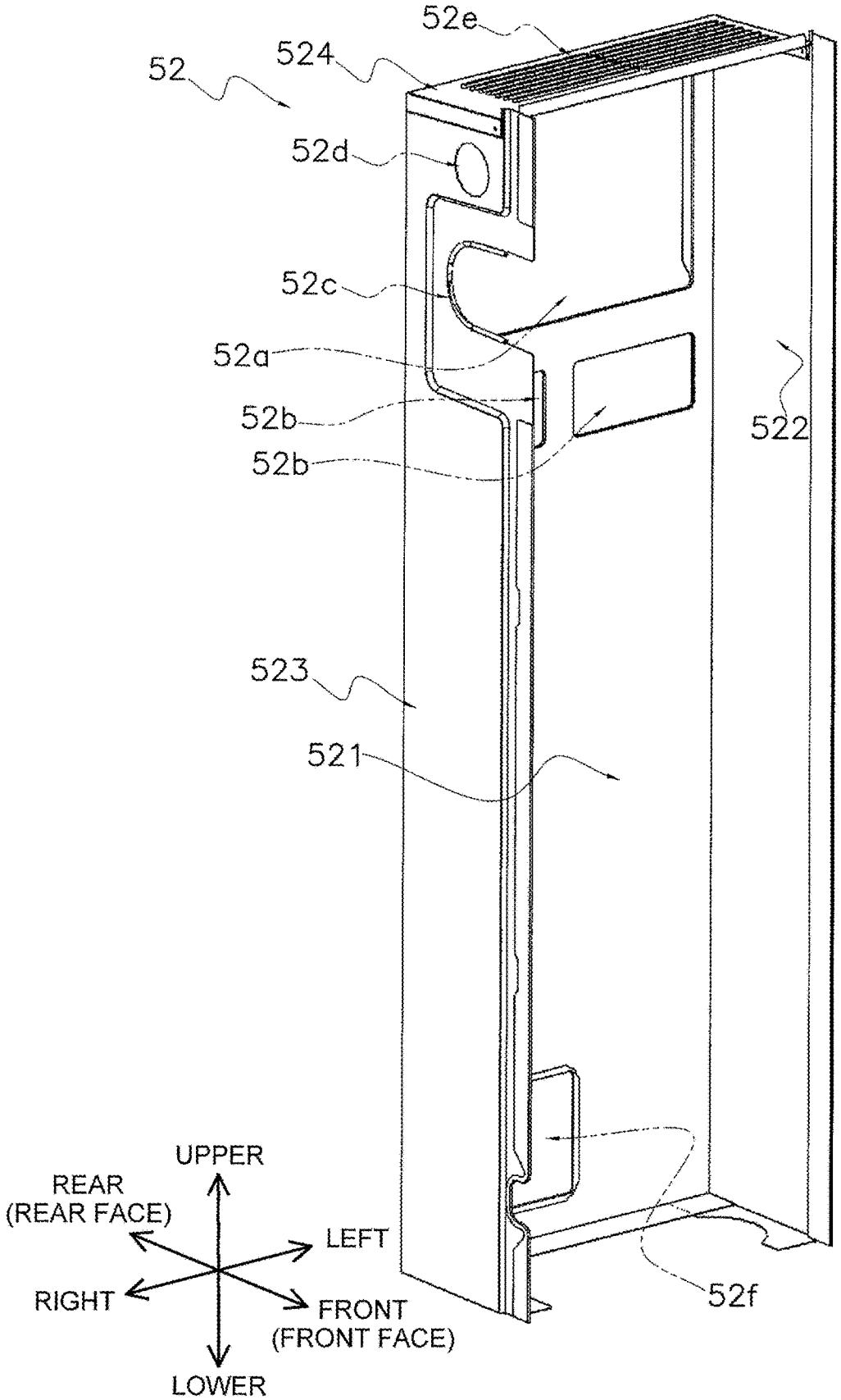
FIG. 15 is a front perspective view of the main body frame seen from an angle different from that in FIG. 14.
Figure 16:
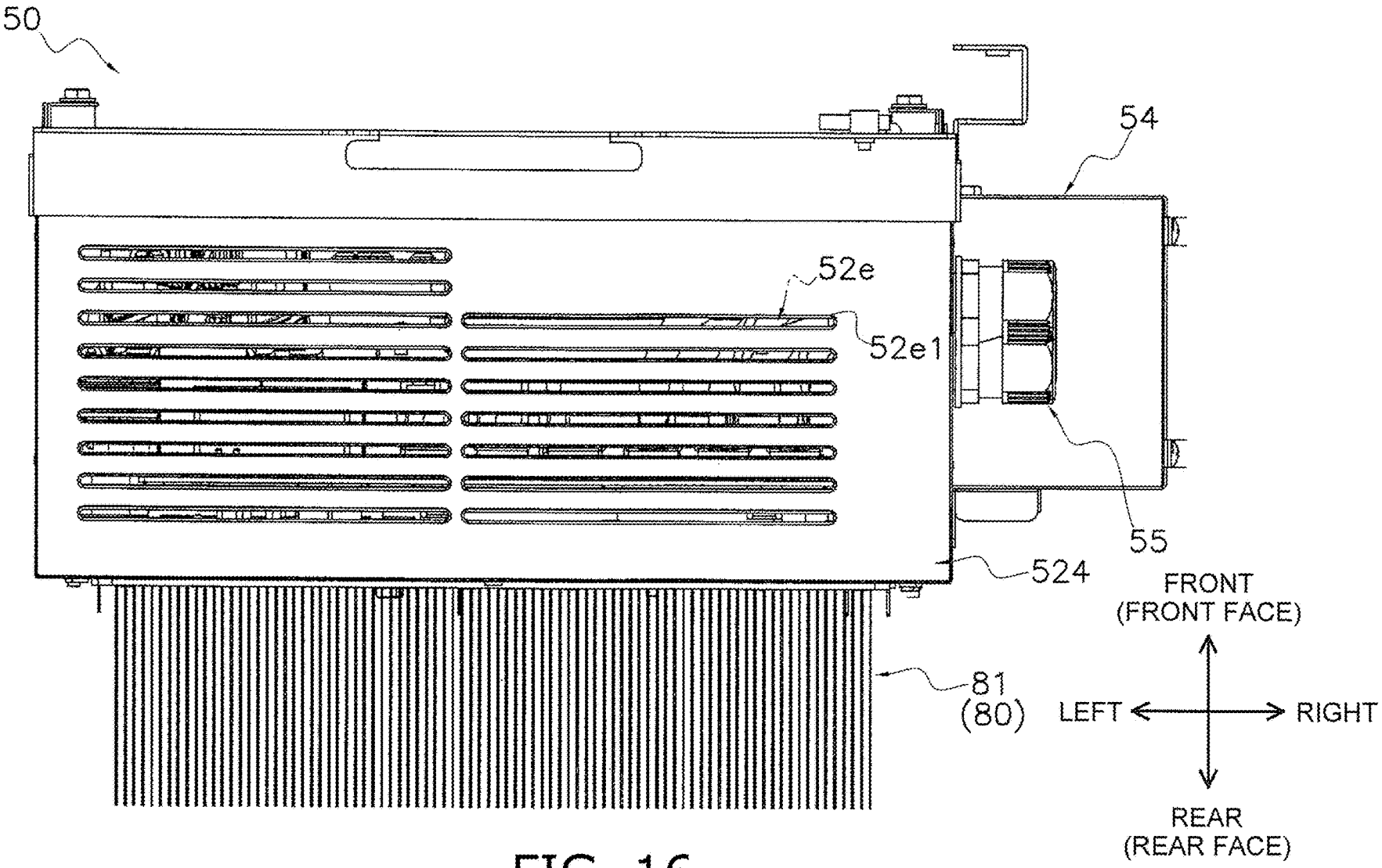
FIG. 16 is a top view of the electric component box from which a top face cover is detached.

FIG. 14 is a front perspective view of the main body frame 52. FIG. 15 is a front perspective view of the main body frame 52 seen from an angle different from that in FIG. 14. FIG. 16 is a top view of the electric component box 50 from which the top face cover 53 is detached.

The main body frame 52 is a housing that is made of metal and constitutes a main body portion of the electric component box 50. The main body frame 52 includes: a rear face part 521 constituting a rear face portion of the electric component box 50; a left side face part 522 constituting a left side face portion of the electric component box 50; a right side face part 523 constituting a right side face portion of the electric component box 50; and a top face part 524 constituting the top face portion of the electric component box 50.

The rear face part 521 has substantially a rectangular shape, and is substantially equal in dimensions to the front face cover 51. The left side face part 522 has substantially a rectangular shape, and extends forward from a left-side end of the rear face part 521. The right side face part 523 has substantially a rectangular shape, and extends forward from a right-side end of the rear face part 521. The top face part 524 has substantially a rectangular shape, and is connected to an upper end portion of the rear face part 521, an upper end portion of the left side face part 522, and an upper end portion of the right side face part 523. Each of the rear face part 521, the left side face part 522, and the right side face part 523 has a lower end portion bent horizontally and elongated along the bottom frame 43 such that the main body frame 52 is disposed upright on the bottom frame 43 of the outdoor unit casing 40.

The main body frame 52 (the rear face part 521) has a plurality of openings. Specifically, the main body frame 52 has a first opening 52*a* from which heat radiating fins (first cooling unit fins 81 to be described later) of the first cooling unit 80 are exposed to the air blowing space 51. The first opening 52*a* is formed at a position corresponding to a position at which the first cooling unit 80 and compressor control board 76 are disposed.

The main body frame 52 (the rear face part 521) also has second openings 52*b* from which heat radiating fins (second cooling unit fins 86 to be described later) of the second cooling units 85 are exposed to the air blowing space 51. The second openings 52*b* are equal in number (two in this embodiment) to the second cooling units 85. The second openings 52*b* are in one-to-one correspondence with the second cooling units 85. The heat radiating fins of the second cooling units 85 are respectively exposed from the second openings 52*b*. Each of the second openings 52*b* is located below the first opening 52*a*, and is formed at a position corresponding to a position where the corresponding second cooling unit 85 and fan control board 77 are disposed.

The main body frame 52 (the right side face part 523) also has a third opening 52*c* through which electric wires (high-voltage wires, low-voltage wires) connected to electric components mounted on the control boards 71, compressor control board 76, and fan control boards 77 are drawn into the electric component box 50. The third opening 52*c* is formed at a position corresponding to the upper space SP2, by cutting a part of the right side face part 523 into substantially a U shape.

The main body frame 52 (the right side face part 523) also has a fourth opening 52*d* through which power wires connected to the compressor 12 are drawn into the electric component box 50. The fourth opening 52*d* is located above the third opening 52*c*, and is formed by punching a part of the right side face part 523 into substantially an 0 shape.

The main body frame 52 (the top face part 524) also has a plurality of fifth openings 52*e* each functioning as an "exhaust port" through which air is discharged from the electric component box 50. In this embodiment, each fifth opening 52*e* is a slit extending in the left-right direction. As illustrated in FIG. 16, in the top face part 524, the fifth openings 52*e* arranged in the depth direction (the front-rear direction) are formed in two rows in the width direction (the left-right direction). In the state in which the electric component box 50 is disposed in the outdoor unit casing 40, the fifth openings 52*e* are lower in heightwise position than the outdoor fans 18 and higher in heightwise position than the heat radiating fins (the first cooling unit fins 81 to be described later) of the first cooling unit 80. As illustrated in FIG. 16, each fifth hole 52*e* is subjected to burring, so that an edge portion (a fifth opening edge part 52*e*1) of each fifth opening 52*e* extends upward. Such fifth opening edge parts 52*e*1 suppress the entry of liquid into the inner space SP through the fifth openings 52*e* even when the liquid adheres to an upper face of the top face part 524.

The main body frame 52 (the rear face part 521) also has, near its lower end, a sixth opening 52*f* through which a service engineer accesses the compressor 12 for maintenance and other purposes.

(4-2-3) Top Face Cover 53

FIG. 17 is a perspective view of the top face cover 53. FIG. 18 is a perspective view of the top face cover 53 seen from an angle different from that in FIG. 17.

The top face cover 53 (which is an example of a "cover part" in the claims) is a sheet metal member covering an upper end portion of the main body frame 52 from above so as to suppress the entry of liquid into the inner space SP through the fifth openings 52*e* in the top face part 524 of the main body frame 52. The top face cover 53 is upwardly spaced apart from the fifth openings 52*e*. The top face cover 53 includes an upper cover part 531, a left lateral cover part 532, and a right lateral cover part 533.

The upper cover part 531 is a portion covering the top face part 524 (the fifth openings 52*e*) of the main body frame 52 from above. The upper cover part 531 has substantially a rectangular shape in plan view, and is larger in area than the top face part 524 of the main body frame 52.

The left lateral cover part 532 externally covers a portion near an upper end of the left side face part 522 of the main body frame 52. The left lateral cover part 532 is a portion extending downward from a left end of the upper cover part 531.

The right lateral cover part 533 externally covers a portion near an upper end of the right side face part 523 of the main body frame 52. The right lateral cover part 533 is a portion extending downward from a right end of the upper cover part 531. The right lateral cover part 533 has an opening 53*a* at a position superimposed on the fourth opening 52*d*.

(5) First Side Face Cover 54 and Second Side Face Cover 55

The electric component box 50 includes a first side face cover 54 configured to suppress the entry of liquid into the inner space SP through the third opening 52*c* in the right side face part 523, and a second side face cover 55 configured to suppress the entry of liquid into the inner space SP through the fourth opening 52*d* in the right side face part 523.

(5-1) First Side Face Cover 54

Figure 19:
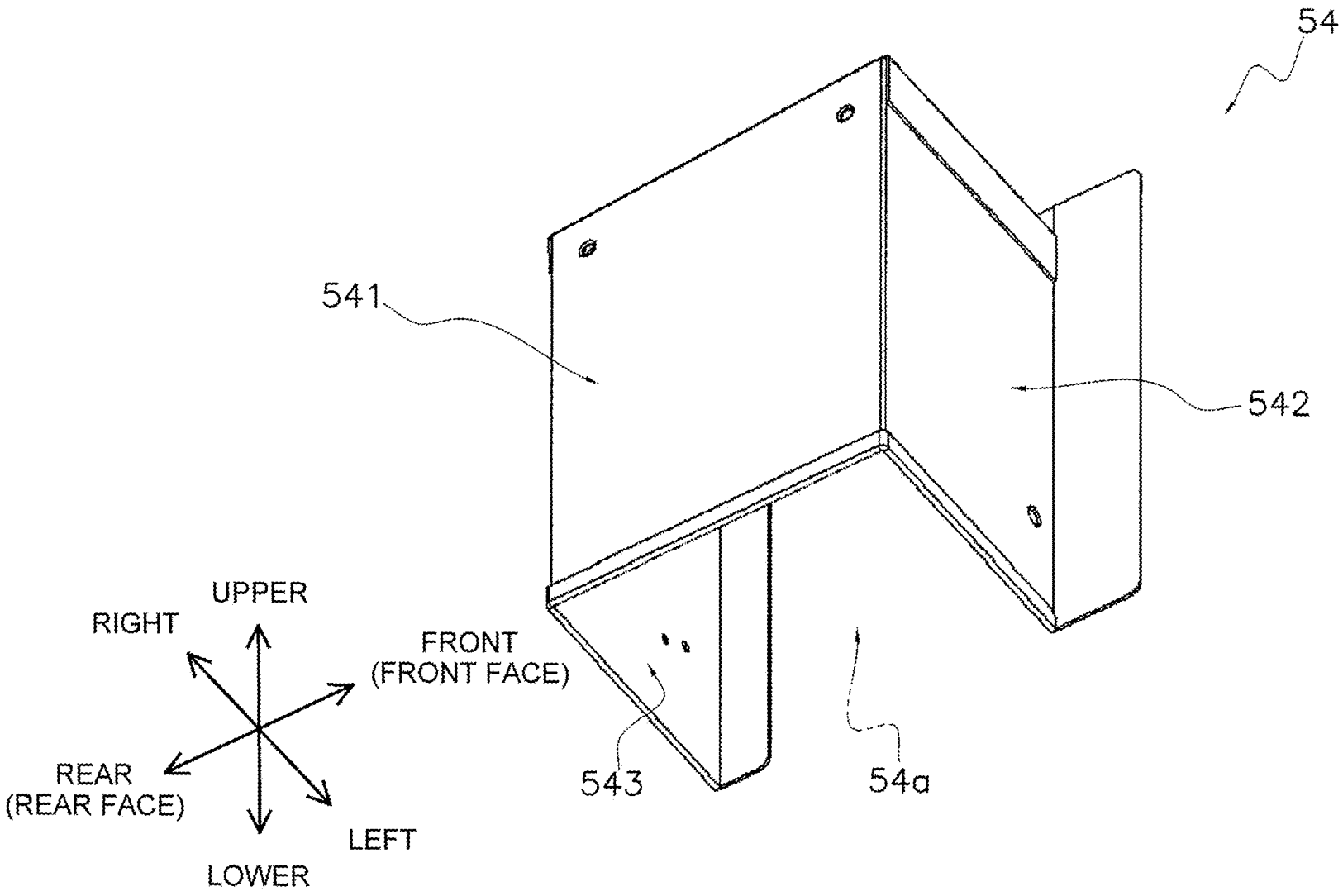
FIG. 19 is a perspective view of a first side face cover.
Figure 20:
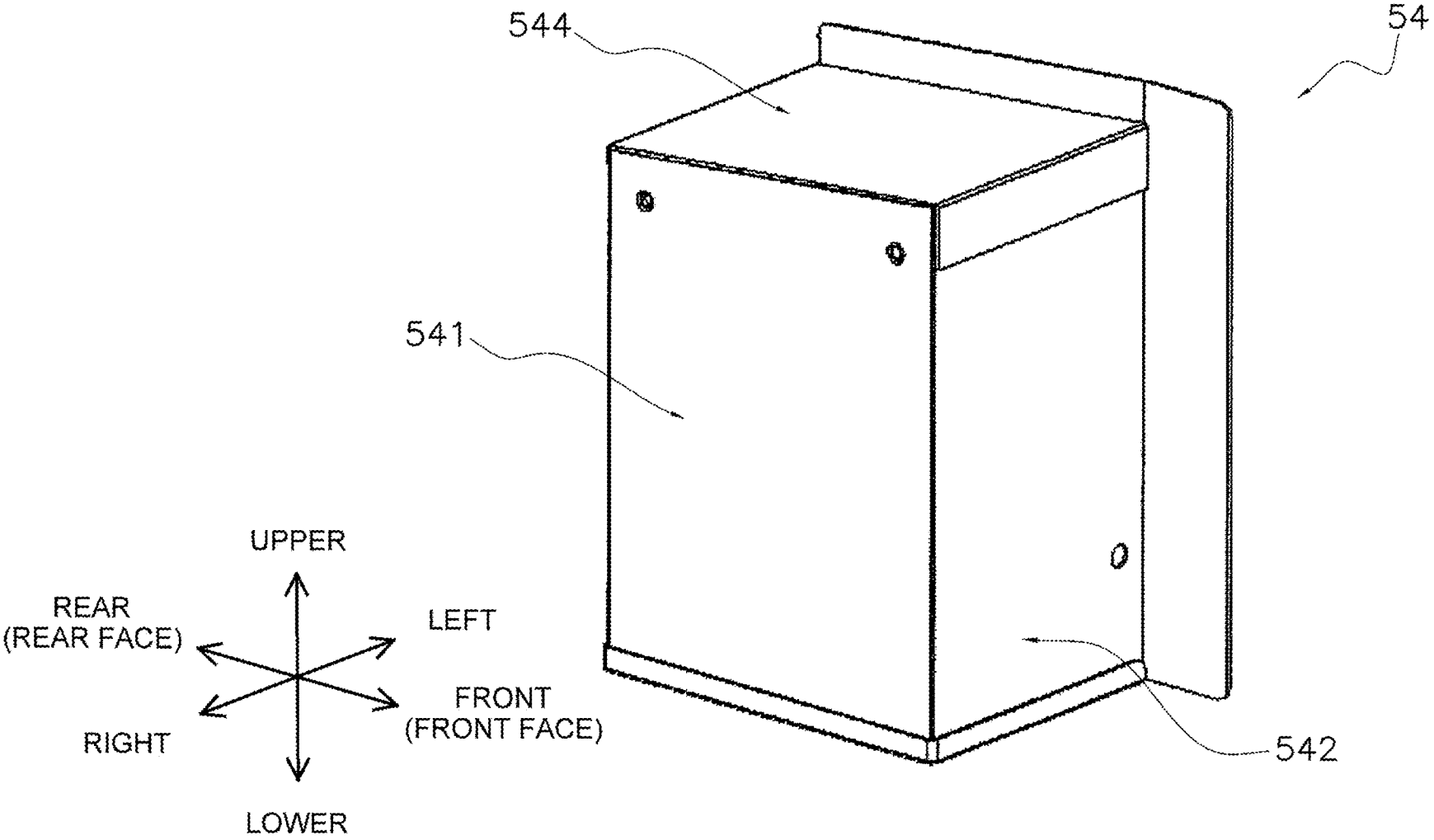
FIG. 20 is a perspective view of the first side face cover seen from an angle different from that in FIG. 19.

FIG. 19 is a perspective view of the first side face cover 54. FIG. 20 is a perspective view of the first side face cover 54 seen from an angle different from that in FIG. 19.

The first side face cover 54 is a sheet metal member externally covering the third opening 52*c* in the right side face part 523 of the main body frame 52 from above and from sideward so as to suppress the entry of liquid into the inner space SP through the third opening 52*c* in the main body frame 52. The first side face cover 54 includes a right-side part 541, a front-side part 542, a rear-side part 543, and an upper part 544.

The right-side part 541 is a portion covering the third opening 52*c* from a right side of the third opening 52*c*. The right-side part 541 has substantially a rectangular shape.

The front-side part 542 is a portion covering the third opening 52*c* from a front side of the third opening 52*c*. The front-side part 542 has substantially a rectangular shape.

The rear-side part 543 is a portion covering the third opening 52*c* from a rear side of the third opening 52*c*. The rear-side part 543 has substantially a rectangular shape.

The upper part 544 is a portion covering the third opening 52*c* from an upper side of the third opening 52*c*. The upper part 544 has substantially a rectangular shape.

The first side face cover 54 has a bottom portion that is open. In other words, the first side face cover 54 has an open portion 54*a* that is open downward. The open portion 54*a* functions as an opening through which the electric wires to be drawn into the inner space SP through the third opening 52*c* pass.

(5-2) Second Side Face Cover 55

The second side face cover 55 is a cover externally covering the fourth opening 52*d* in the right side face part 523 of the main body frame 52 from above and from sideward so as to suppress the entry of liquid into the inner space SP through the fourth opening 52*d* in the main body frame 52. The second side face cover 55 is a general-purpose product that is commonly available. The second side face cover 55 has a plurality of (three in this embodiment) openings through which the power wires connected to the compressor 12 pass.

(6) First Cooling Unit 80 and Second Cooling Units 85

In the electric component box 50, the first cooling unit 80 and the second cooling units 85 are disposed for cooling the heat generating components in the inner space SP.

(6-1) First Cooling Unit 80

Figure 21:
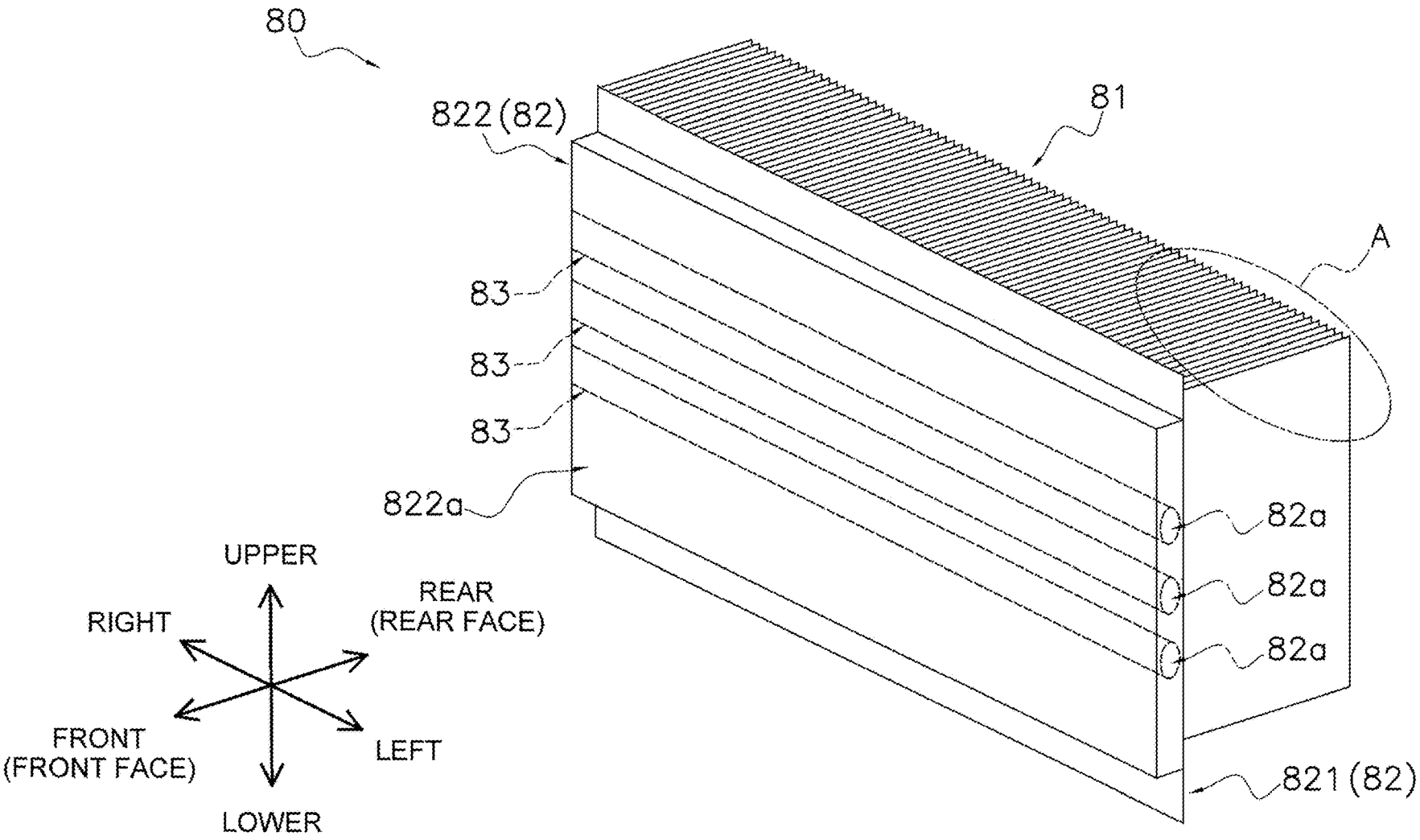
FIG. 21 is a perspective view of a first cooling unit.
Figure 22:
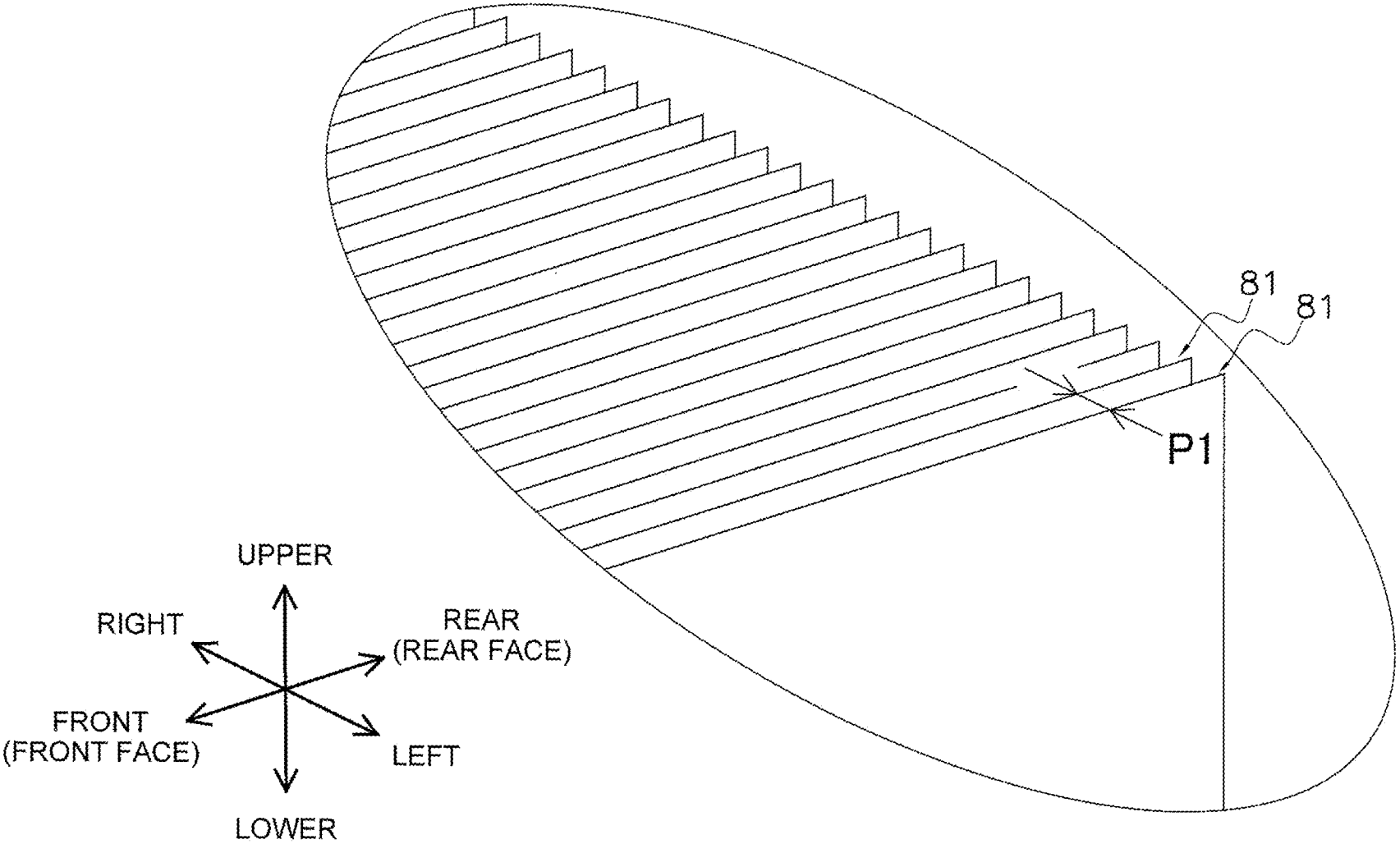
FIG. 22 is an enlarged view of segment A in FIG. 21.

FIG. 21 is a perspective view of the first cooling unit 80. FIG. 22 is an enlarged view of segment A in FIG. 21.

The first cooling unit 80 (which is an example of a "first cooler" in the claims) is a unit for cooling the compressor controlling electric components 63 (mainly the high-heat generating electric component 65) on the compressor control board 76. The first cooling unit 80 is thermally connected to the high-heat generating electric component 65 in an installed state. The first cooling unit 80 includes the plurality of first cooling unit fins 81 for heat exchange with outdoor air flows AF, a first cooling unit main body 82, and a plurality of (three in this embodiment) heat pipes 83.

Each first cooling unit fin 81 (which is an example of a "first heat radiating fin" in the claims) is a plate-shaped fin made of metal. As illustrated in FIG. 22, in the first cooling unit 80, a large number of first cooling unit fins 81 are arranged in the width direction (the left-right direction) with spacings each of which is equal to or more than a predetermined length (a first fin pitch P1). In other words, each first cooling unit fin 81 and another first cooling unit fin 81 adjacent thereto are spaced apart from each other by at least the first fin pitch P1. Each first cooling unit fin 81 has a front-side end connected to the first cooling unit main body 82. The first cooling unit fins 81 are located on flow paths of outdoor air flows AF in the installed state.

The first cooling unit main body 82 is a plate-shaped member that is thick and is made of metal. The first cooling unit main body 82 is interposed between the first cooling unit fins 81 and the heat pipes 83 to thermally connect the first cooling unit fins 81 to the heat pipes 83. The first cooling unit main body 82 includes a fin holding part 821 and a heat pipe holding part 822. The fin holding part 821 is integrated with the heat pipe holding part 822.

The fin holding part 821 is a plate-shaped portion constituting a rear face portion of the first cooling unit main body 82, and is interposed between the first cooling unit fins 81 and the heat pipes 83. The fin holding part 821 thermally connects the first cooling unit fins 81 to the heat pipes 83. The fin holding part 821 is connected to the front-side end of each first cooling unit fin 81 to hold each first cooling unit fin 81. The fin holding part 821 is larger in heightwise length than each first cooling unit fin 81. In addition, the fin holding part 821 has an area that is equal to or more than an area of the first opening 52*a* as seen from the front face or the rear face (as seen from the front-rear direction). In this regard, the fin holding part 821 closes the first opening 52*a* to separate the inner space SP from a space outside the electric component box 50 in the installed state.

The heat pipe holding part 822 is a portion constituting a front face portion of the first cooling unit main body 82. The heat pipe holding part 822 is interposed between the high-heat generating electric component 65 and the heat pipes 83 to thermally connect the high-heat generating electric component 65 to the heat pipes 83 in the installed state. The heat pipe holding part 822 is larger in thickness than the fin holding part 821. The heat pipe holding part 822 has a plurality of heat pipe insertion holes 82*a* into which the heat pipes 83 are inserted horizontally (the left-right direction in this embodiment). The heat pipe insertion holes 82*a* are equal in number to the heat pipes 83. The heat pipe holding part 822 is smaller in heightwise length than the fin holding part 821. The heat pipe holding part 822 has a front face part 822*a* directed to the front face, and is in contact at the front face part 822*a* with the high-heat generating electric component 65.

Each heat pipe 83 is a metal tube (e.g., a copper tube) in which a coolant for cooling the high-heat generating electric component 65 is sealed. The coolant sealed in each heat pipe 83 exchanges heat with the high-heat generating electric component 65. The coolant is selected in accordance with design specifications and installation environments. The coolant is, for example, water. The heat pipes 83 are respectively inserted into the heat pipe insertion holes 82*a*. In other words, the heat pipes 83 are built in the first cooling unit main body 82 (the heat pipe holding part 822). The heat pipe holding part 822 is crimped with the heat pipes 83 inserted into the heat pipe insertion holes 82*a* in order to increase an amount of heat to be exchanged between the heat pipes 83 and the electric components by an increase in contact area of the heat pipes 83 with edge portions, where the heat pipe insertion holes 82*a* are formed, of the heat pipe holding part 822.

The first cooling unit main body 82 in which the heat pipes 83 are built is interposed between the high-heat generating electric component 65 and the first cooling unit fins 81 in the installed state. In other words, the heat pipes 83 are interposed between the high-heat generating electric component 65 and the first cooling unit fins 81, and are thermally connected to both the high-heat generating electric component 65 and the first cooling unit fins 81. Each heat pipe 83 is disposed with its longitudinal axis extending horizontally in the installed state. The state in which "the longitudinal axis extends horizontally" used in this embodiment involves not only a case where the longitudinal axis of each heat pipe 83 exactly extends in the horizontal direction, but also a case where the longitudinal axis of each heat pipe 83 is tilted relative to the horizontal direction within a predetermined angular range (e.g., 30 degrees).

(6-2) Second Cooling Units 85

Figure 23:
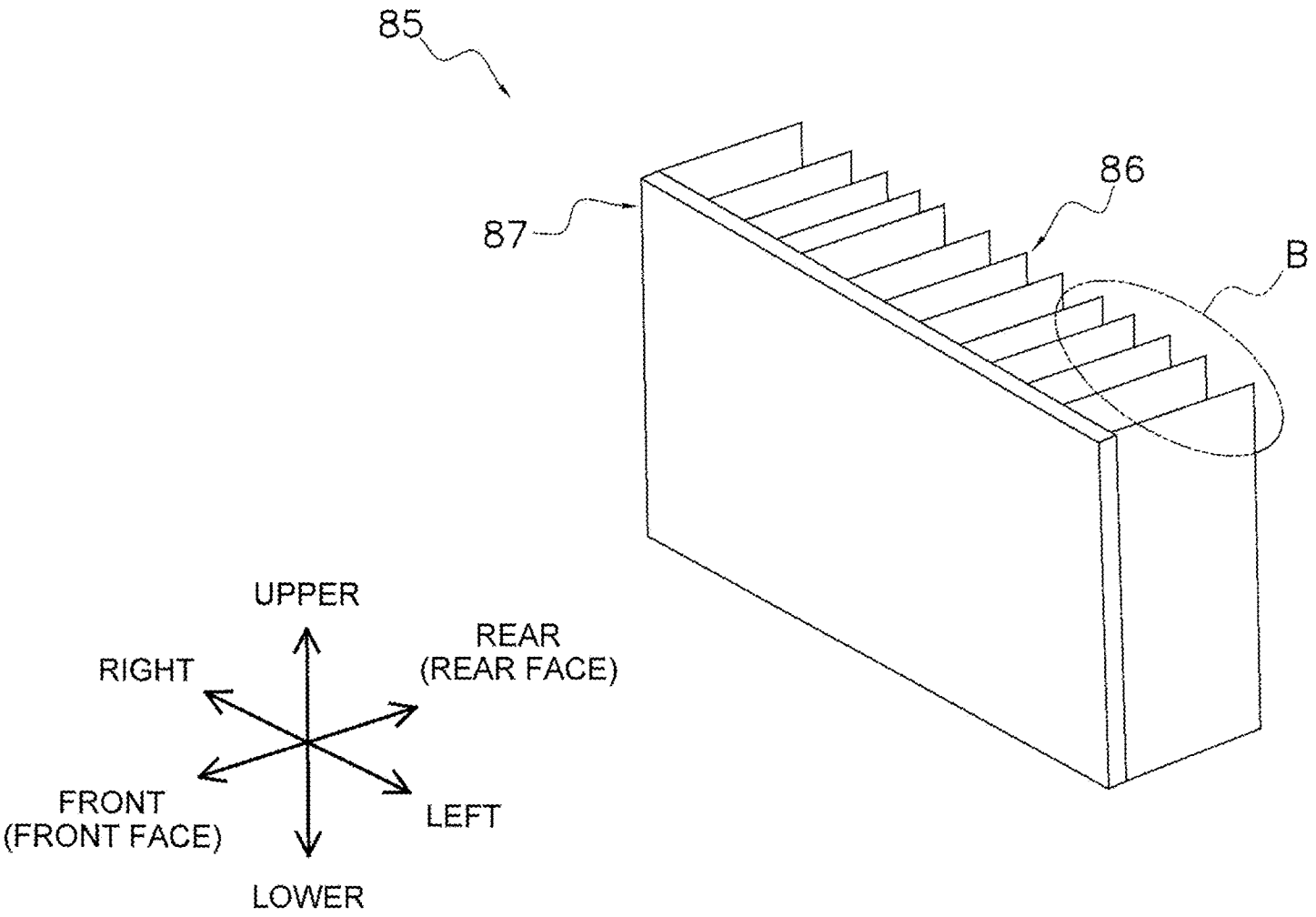
FIG. 23 is a perspective view of a second cooling unit.
Figure 24:
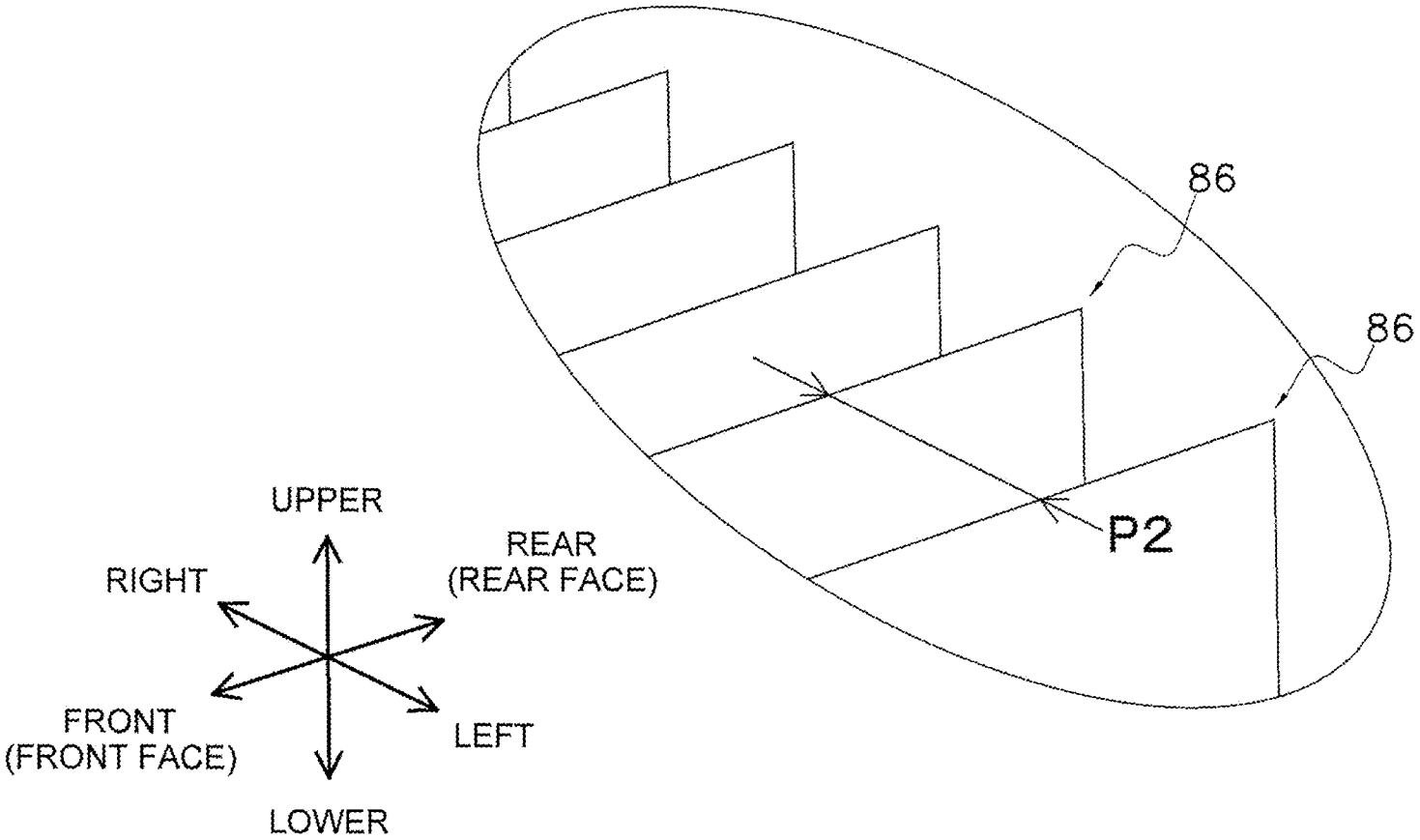
FIG. 24 is an enlarged view of segment B in FIG. 23.

FIG. 23 is a perspective view of one of the second cooling units 85. FIG. 24 is an enlarged view of segment B in FIG. 23.

Each second cooling unit 85 (which is an example of a "second cooler" in the claims) is a unit for cooling the corresponding fan controlling electric component 66 on the fan control board 77. The second cooling units 85 are thermally connected to the fan controlling electric components 66 in the installed state. Each second cooling unit 85 includes the plurality of second cooling unit fins 86 for heat exchange with outdoor air flows AF, and a second cooling unit main body 87.

Each second cooling unit fin 86 (which is an example of a "second heat radiating fin" in the claims) is a plate-shaped fin made of metal. As illustrated in FIG. 24, in each second cooling unit 85, a large number of second cooling unit fins 86 are arranged in the width direction (the left-right direction) with spacings each of which is equal to or more than a predetermined length (a second fin pitch P2). In other words, each second cooling unit fin 86 and another second cooling unit fin 86 adjacent thereto are spaced apart from each other by at least the second fin pitch P2. Each second cooling unit fin 86 has a front-side end connected to the second cooling unit main body 87. The second cooling unit fins 86 are located on flow paths of outdoor air flows AF in the installed state.

The second fin pitch P2 is longer than the first fin pitch P1. In this embodiment, the second fin pitch P2 is at least twice as long as the first fin pitch P1. In other words, each second cooling unit 85 is lower than the first cooling unit 80 as to a density of heat radiating fins (the second cooling unit fins 86). In this regard, each second cooling unit 85 is smaller than the first cooling unit 80 as to the number of heat radiating fins. Specifically, in the first cooling unit 80, the heat radiating fins are arranged with a fin pitch (the first fin pitch P1) shorter than that in the second cooling units 85. In this regard, the heat radiating fins (the first cooling unit fins 81) larger in number than those of each second cooling unit 85 are arranged at a higher density.

The second cooling unit main body 87 is a plate-shaped member made of metal. The second cooling unit main body 87 is connected to the front-side end of each second cooling unit fin 86 to hold each second cooling unit fin 86. The second cooling unit main body 87 is larger in heightwise length than each second cooling unit fin 86. In addition, the second cooling unit main body 87 has an area that is equal to or more than an area of the corresponding second opening 52*b* as seen from the front face or the rear face (as seen from the front-rear direction). In this regard, the second cooling unit main body 87 closes the corresponding second opening 52*b* to separate the inner space SP from a space outside the electric component box 50 in the installed state. The second cooling unit main body 87 has a front face portion that is in contact with and is thermally connected to the corresponding fan controlling electric component 66 on the fan control board 77 in the installed state.

Each second cooling unit 85 is not provided with a heat pipe unlike the first cooling unit 80, and is smaller in number of heat radiating fins than the first cooling unit 80. Each second cooling unit 85 is therefore lower in cooling performance than the first cooling unit 80.

(7) Assembling of Electric Component Box 50

FIG. 25 is a schematic view about how the compressor control board 76, the fan control boards 77, the first cooling unit 80, and the second cooling units 85 are fixed to the main body frame 52.

(7-1) Fixing of Compressor Control Board 76 and First Cooling Unit 80

First, the high-heat generating electric component 65 (the power module) is fastened to the first cooling unit 80 (specifically, the front face part 822*a* of the heat pipe holding part 822) with screws. At this time, the high-heat generating electric component 65 is fixed to the first cooling unit 80 in close contact with the front face part 822*a* so as to facilitate heat exchange with the heat pipes 83. Thereafter, the high-heat generating electric component 65 fixed to the first cooling unit 80 is mounted on the rear face side of the compressor control board 76.

Thereafter, the compressor control board 76 and the first cooling unit 80 to which the high-heat generating electric component 65 is fixed are fastened to a first fitting 57 with screws independently of each other.

The first fitting 57 is a metal sheet for fixing the first cooling unit 80 and the compressor control board 76 to the main body frame 52. The first fitting 57 is fastened to the periphery of the first opening 52*a* in the main body frame 52 (the rear face part 521) with screws. The first fitting 57 has substantially a rectangular shape. The first fitting 57 has in its center a large opening through which the first cooling unit fins 81 pass.

The compressor control board 76 and the first cooling unit 80 are not necessarily fixed as described above, and may be fixed in any manner. For example, the high-heat generating electric component 65 and the compressor control board 76 may be fastened to the first cooling unit 80 or the first fitting 57 with screws after the first cooling unit 80 is fixed to the main body frame 52 via the first fitting 57.

Figure 27:
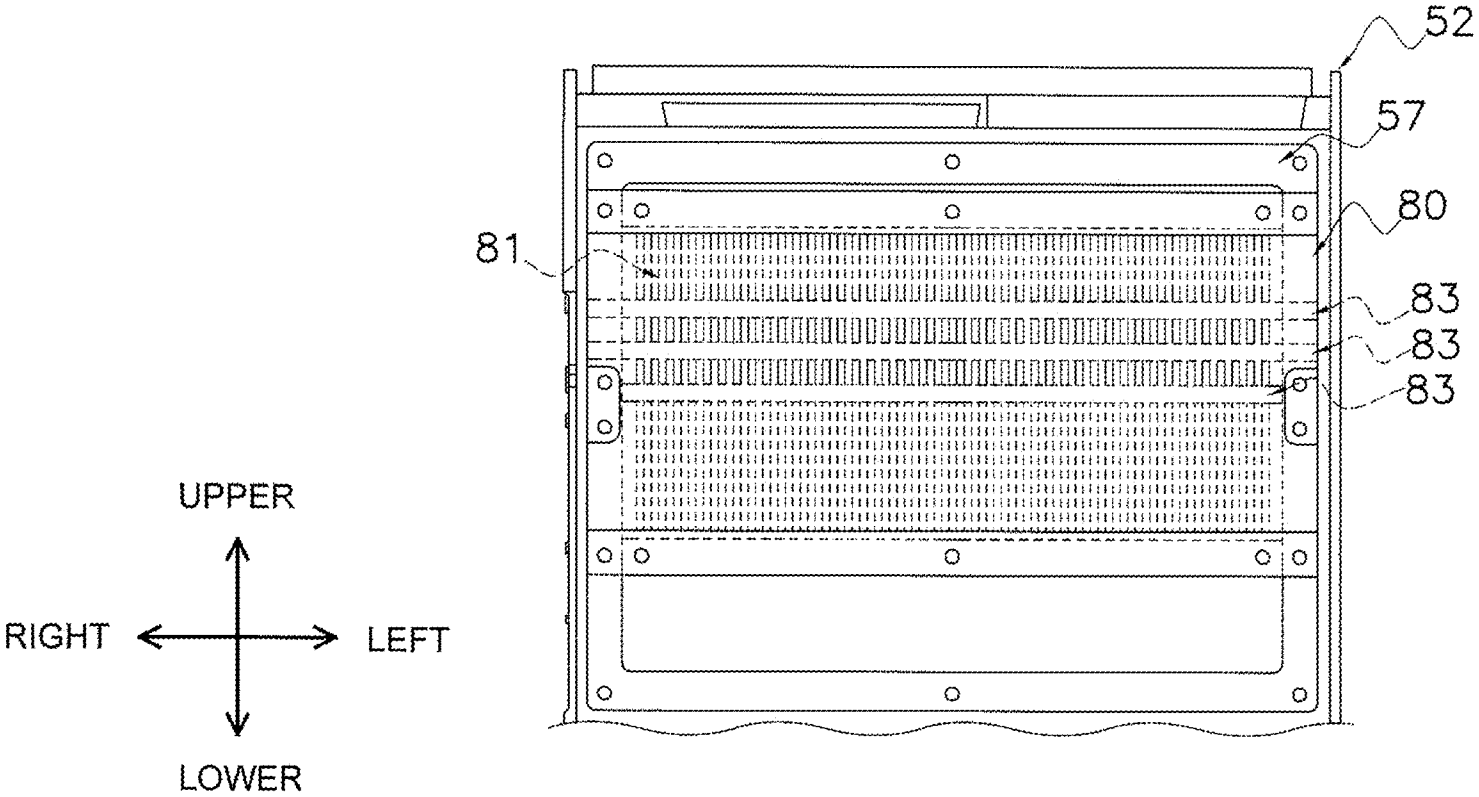
FIG. 27 is a front view of the first cooling unit fixed to the main body frame.
Figure 28:
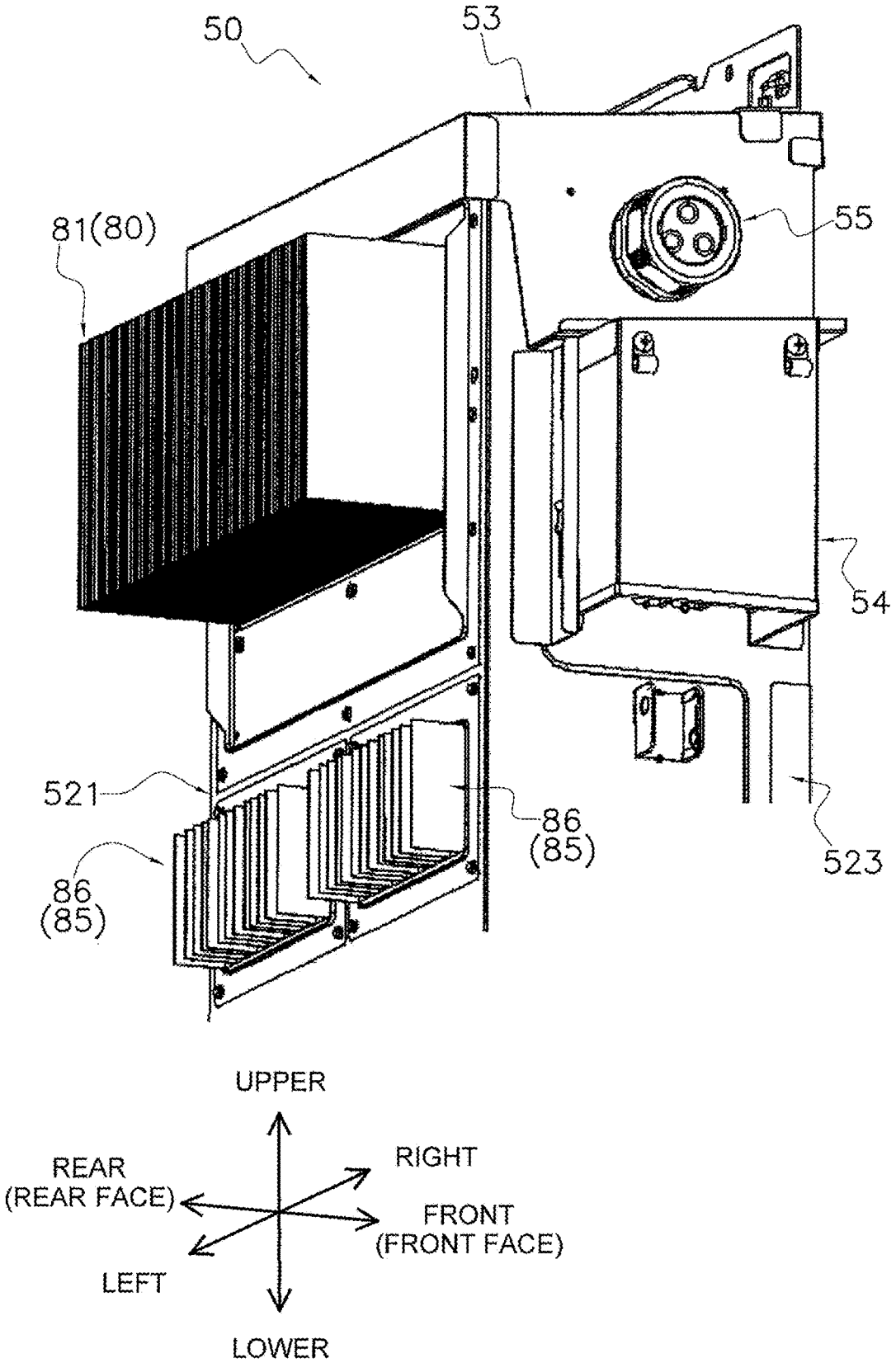
FIG. 28 is a rear perspective view of the first cooling unit and the second cooling unit in an installed state.

FIG. 26 is a front perspective view of the high-heat generating electric component 65 (the power module) fixed to the first cooling unit 80. FIG. 27 is a front view of the first cooling unit 80 fixed to the main body frame 52. FIG. 28 is a rear perspective view of the first cooling unit 80 and the second cooling units 85 in the installed state.

As illustrated in FIG. 28, the first cooling unit fins 81 extend rearward through the first opening 52*a* and protrude toward the space (the air blowing space S1) outside the electric component box 50 so as to exchange heat with outdoor air flows AF in the installed state. The first cooling unit main body 82 (the fin holding part 821) closes the first opening 52*a* to separate the inner space SP from the space outside the electric component box 50. In the electric component box 50, the heat pipes 83 of the first cooling unit 80 are housed in the heat pipe holding part 822, and are shielded from the space (mainly the air blowing space S1) outside the electric component box 50 in the installed state. The first cooling unit 80 is adjacent to the compressor control board 76 (the compressor controlling electric component mount portion 75*a*) in the installed state. In this regard, the heat pipes 83 are adjacent to the high-heat generating electric component 65 so as to exchange heat with the high-heat generating electric component 65.

(7-2) Fixing of Fan Control Boards 77 and Second Cooling Units 85

First, the fan control boards 77 are respectively fastened to the second cooling units 85 (specifically, the second cooling unit main bodies 87) with screws. At this time, the fan control boards 77 are fixed to the second cooling units 85 such that the fan controlling electric components 66 are in close contact with the second cooling unit main bodies 87 in order to facilitate cooling of the fan controlling electric components 66.

Thereafter, the second cooling units 85 and fan control boards 77 are respectively fastened to second fittings 58 with screws independently of each other.

Each second fitting 58 is a metal sheet for fixing the corresponding second cooling unit 85 and fan control board 77 to the main body frame 52. Each second fitting 58 is fastened to the periphery of the corresponding second opening 52*b* in the main body frame 52 (the rear face part 521) with screws. Each second fitting 58 has substantially a rectangular shape. Each second fitting 58 has in its center a large opening through which the second cooling unit fins 86 pass.

The fan control boards 77 and the second cooling units 85 are not necessarily fixed as described above, and may be fixed in any manner. For example, the fan control boards 77 may be fastened to the second cooling units 85 or the second fittings 58 with screws after the second cooling units 85 are fixed to the main body frame 52 via the second fittings 58.

As illustrated in FIG. 28, the second cooling unit fins 86 respectively extend rearward through the second openings 52*b* and protrude toward the space (the air blowing space S1) outside the electric component box 50 so as to exchange heat with outdoor air flows AF in the installed state. The second cooling unit main body 87 closes the second openings 52*b* to separate the inner space SP from the space outside the electric component box 50. Each second cooling unit 85 is adjacent to the corresponding fan control board 77 in the installed state.

(8) Cooling of Compressor Controlling Electric Components 63 and Fan Controlling Electric Components 66

Figure 29:
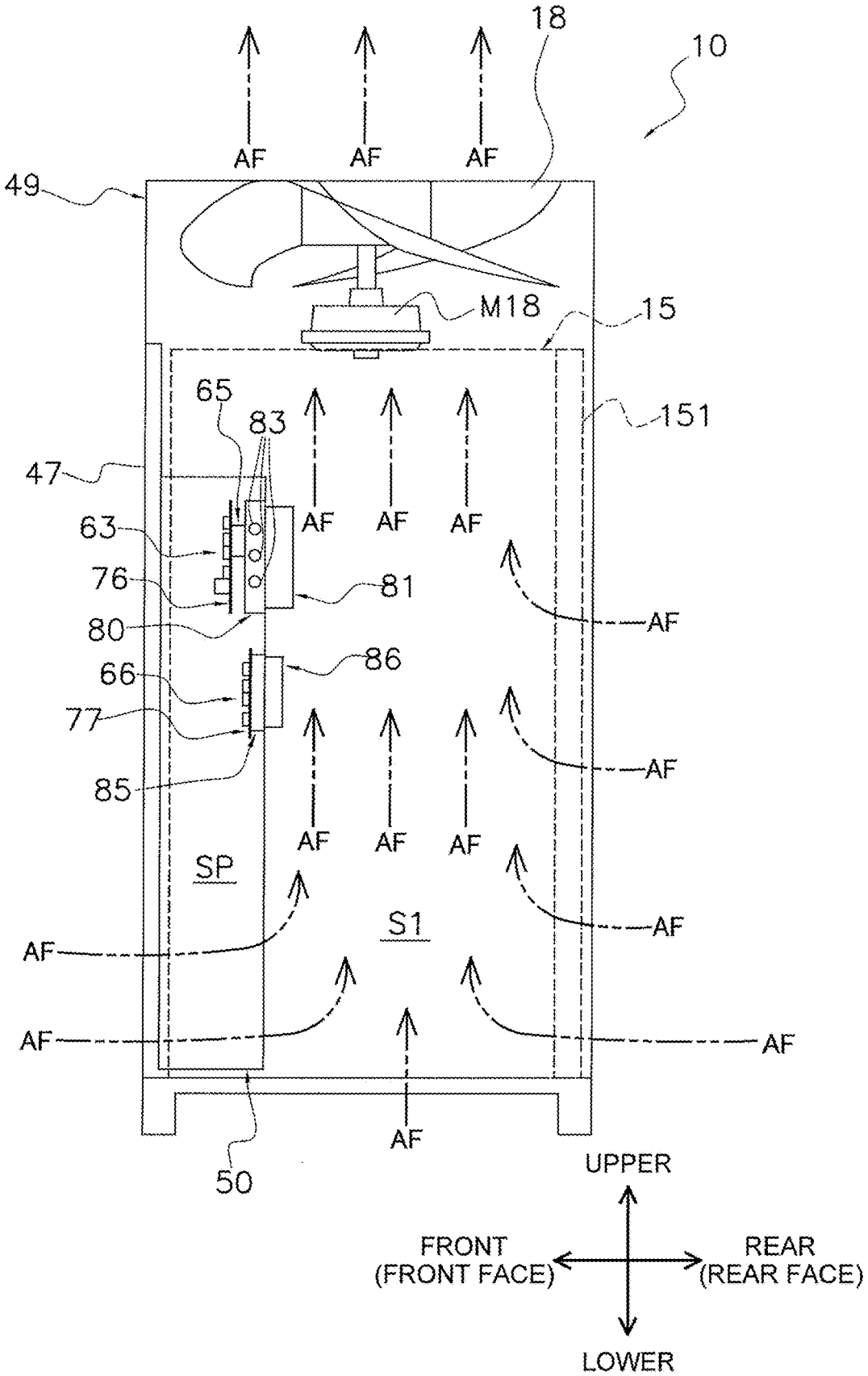
FIG. 29 is a schematic view of a relationship between positions of the compressor control board (high-heat generating electric component), first cooling unit (first cooling unit fin), fan control board (fan controlling electric component), and second cooling unit (second cooling unit fin) and air flow paths of outdoor air flows.

FIG. 29 is a schematic view of a relationship between the positions of the compressor control board 76 (high-heat generating electric component 65), first cooling unit 80 (first cooling unit fins 81), fan control boards 77 (fan controlling electric components 66), and second cooling units 85 (second cooling unit fins 86) and air flow paths of outdoor air flows AF.

As described above, outdoor air flows AF flow into the outdoor unit casing 40 through the intake ports 401 in the left side face, right side face, and rear face of the outdoor unit casing 40, and pass through the outdoor heat exchanger 15 (the heat exchange faces 151). The outdoor air flows AF then mainly flow from below upward. As illustrated in FIG. 29, the first cooling unit 80 is adjacent to the compressor control board 76 (the high-heat generating electric component 65), and the first cooling unit fins 81 are located on the flow paths of the outdoor air flows AF. In addition, the second cooling units 85 are respectively adjacent to the fan control boards 77 (the fan controlling electric components 66), and the second cooling unit fins 86 are located on the flow paths of the outdoor air flows AF.

During operation, in the outdoor unit 10, the high-heat generating electric component 65 on the compressor control board 76 is cooled by heat exchange with the coolant in each heat pipe 83 of the first cooling unit 80. The heat of the coolant in each heat pipe 83 heated by the heat exchange with the high-heat generating electric component 65 is transmitted to the first cooling unit fins 81, and then is radiated to the outdoor air flows AF. In other words, the heat pipes 83 for cooling the high-heat generating electric component 65 are cooled by heat exchange with the outdoor air flows AF via the first cooling unit fins 81. In other words, the high-heat generating electric component 65 is cooled by heat exchange with the outdoor air flows AF via the heat pipes 83 and the first cooling unit fins 81.

In addition, the fan controlling electric components 66 on the fan control boards 77 are cooled by heat exchange with the outdoor air flows AF via the second cooling unit fins 86 of the second cooling units 85.

As illustrated in FIG. 29, the first cooling unit fins 81 are lower in heightwise position than the outdoor fans 18 and higher in heightwise position than the second cooling unit fins 86. In other words, the first cooling unit fins 81 are on the leeward side of the outdoor air flows AF with respect to the second cooling unit fins 86. In this regard, the first cooling unit 80 exchanges heat with the outdoor air flows AF subjected to heat exchange with the second cooling unit fins 86. In other words, the second cooling unit fins 86 exchange heat with outdoor air flows AF before being subjected to heat exchange with the first cooling unit 80.

In addition, the first cooling unit fins 81 are closer in heightwise position to the outdoor fans 18 than the second cooling unit fins 86 are. In this regard, the outdoor air flows AF passing around the first cooling unit 80 are larger in airflow volume than the outdoor air flows AF passing around the second cooling unit fins 86.

In addition, the heat pipes 83 are separated from the air blowing space S1 and are shielded from the outdoor air flows AF by the first cooling unit main body 82 (the fin holding part 821, the heat pipe holding part 822). In this regard, the weather resistance of each heat pipe 83 is enhanced.

(9) Features (9-1)

In refrigeration apparatuses, recently, most compressors are subjected to inverter control such that their capacities are variable. Typically, various electric components (e.g., a power device, a power module) configured to perform inverter control on such a compressor are mounted on a board disposed in an outdoor unit. Normally, electric components configured to control devices (e.g., an outdoor fan) other than the compressor are also mounted on the board. This respect also applies the outdoor unit 10 according to this embodiment.

In the outdoor unit 10 according to this embodiment, the compressor 12 is disposed on the bottom frame 43 in the outdoor unit casing 40. In addition, each outdoor fan 18 configured to provide outdoor air flows AF flowing from below upward is higher in heightwise position than the compressor 12 so as to blow out air upward. Also in the outdoor unit 10, as illustrated in FIG. 29, outdoor air flows AF flow from below upward along the first cooling unit fins 81 and second cooling unit fins 86 adjacent to the board unit 75 to cool the electric components (the compressor controlling electric components 63, the fan controlling electric components 66) in the electric component box 50.

In an outdoor unit having such a configuration, normally, an outdoor fan is higher in heightwise position than a compressor; therefore, a fan controlling electric component is disposed above a compressor controlling electric component, that is, the fan controlling electric component is closer to the outdoor fan than the compressor controlling electric component is, for the sake of ease of wiring.

As a result of diligent studies, however, the inventor of this application has found that this layout occasionally fails to ensure reliability since a heat generating component is unsatisfactorily cooled. Specifically, according to the layout described above, the fan controlling electric component is cooled by an outdoor air flow heated by heat exchange with the compressor controlling electric component (particularly, a high-heat generating electric component) considerably larger in heating value than the fan controlling electric component. It is consequently considered that the fan controlling electric component is unfavorably cooled because of an unsatisfactory temperature difference between the fan controlling electric component and the outdoor air flow as a cooling source. Decrease in reliability is caused due to this respect.

In cases where a heat generating component is cooled by an outdoor air flow flowing from below upward as in the outdoor unit 10 according to this embodiment, an airflow volume at a position closer to an outdoor fan (i.e., an airflow volume of the air flow on the leeward side) tends to become larger. It is however considered that when a compressor controlling electric component (a high-heat generating electric component) is on the windward side of an air flow with respect to a fan controlling electric component (i.e., when the compressor controlling electric component is farther from an outdoor fan than the fan controlling electric component is), an airflow volume of an outdoor air flow for cooling the high-heat generating electric component having a larger heating value is unsatisfactorily ensured, so that the high-heat generating electric component is unfavorably cooled. Decrease in reliability is also caused due to this respect.

In view of this respect, in the outdoor unit 10 according to this embodiment, the first cooling unit 80 that is adjacent to the compressor controlling electric component mount portion 75*a* and is configured to cool the high-heat generating electric component 65 includes the plurality of first cooling unit fins 81 located on flow paths of outdoor air flows AF and configured to exchange heat with the outdoor air flows AF. In addition, the high-heat generating electric component 65 is lower in heightwise position than the outdoor fans 18 and higher in heightwise position than the fan controlling electric components 66. This configuration facilitates favorable cooling of both the high-heat generating electric component 65 configured to control the compressor and the fan controlling electric components 66 configured to control the outdoor fans 18, thereby suppressing decrease in reliability.

Specifically, in cooling the high-heat generating electric component 65 and the fan controlling electric components 66 using, as a cooling source, outdoor air flows AF flowing from below upward, when the first cooling unit 80 including the first cooling unit fins 81 is adjacent to the compressor controlling electric component mount portion 75*a* (the high-heat generating electric component 65), and the high-heat generating electric component 65 is lower in heightwise position than the outdoor fans 18 and higher in heightwise position than the fan controlling electric components 66, the fan controlling electric components 66 are on the windward side of the outdoor air flows AF with respect to the high-heat generating electric component 65 (the first cooling unit fins 81). Therefore, the fan controlling electric components 66 are cooled by the outdoor air flows AF prior to the high-heat generating electric component 65 (the first cooling unit fins 81). This configuration thus suppresses a situation in which the fan controlling electric components 66 are unfavorably cooled because of an unsatisfactory temperature difference between the fan controlling electric components 66 and the outdoor air flows AF.

In addition, the high-heat generating electric component 65 (the first cooling unit fins 81) is on the leeward side of the outdoor air flows AF with respect to the fan controlling electric components 66. In other words, the high-heat generating electric component 65 (the first cooling unit fins 81) is closer to the outdoor fans 18 than the fan controlling electric components 66 are. This configuration therefore facilitates ensuring of a satisfactory airflow volume of outdoor air flows AF for cooling the high-heat generating electric component 65 larger in heating value than the fan controlling electric components 66. This configuration thus facilitates favorable cooling of the high-heat generating electric component 65.

The high-heat generating electric component 65 (the first cooling unit fins 81) is cooled by the outdoor air flows AF subjected to heat exchange with the fan controlling electric components 66. However, since the fan controlling electric components 66 are smaller in heating value than the high-heat generating electric component 65, this configuration also suppresses a situation in which a temperature difference between the high-heat generating electric component 65 and the outdoor air flows AF as the cooling source is unsatisfactorily ensured. Also in this respect, this configuration suppresses the situation in which the high-heat generating electric component 65 is unfavorably cooled.

(9-2)

In the outdoor unit 10 according to this embodiment, the second cooling units 85 that are thermally connected to the fan controlling electric components 66 and configured to cool the fan controlling electric components 66 each include the plurality of second cooling unit fins 86. The first cooling unit fins 81 are higher in heightwise position than the second cooling unit fins 86.

This configuration facilitates cooling of the fan controlling electric components 66 while ensuring the cooling performance for the high-heat generating electric component 65 having a larger heating value. Specifically, this configuration facilitates heat exchange between the fan controlling electric components 66 and the outdoor air flows AF by the second cooling unit fins 86, thereby increasing cooling values of the fan controlling electric components 66. When the second cooling unit fins 86 are on the leeward side of the outdoor air flows AF with respect to the first cooling unit fins 81, it is supposed that the fan controlling electric components 66 are unfavorably cooled in some cases because of an unsatisfactory temperature difference between the second cooling unit fins 86 and the outdoor air flows AF. However, this configuration suppresses such a situation since the second cooling unit fins 86 are on the windward side of the outdoor air flows AF with respect to the first cooling unit fins 81.

In addition, since the fan controlling electric components 66 are smaller in heating value than the high-heat generating electric component 65, even when the first cooling unit fins 81 are on the leeward side of the outdoor air flows AF with respect to the second cooling unit fins 86 (i.e., even when the first cooling unit fins 81 are cooled by the outdoor air flows AF subjected to heat exchange with the second cooling unit fins 86), the temperature difference between the first cooling unit fins 81 and the outdoor air flows AF is satisfactorily ensured, so that the high-heat generating electric component 65 is satisfactorily cooled.

(9-3)

In the outdoor unit 10 according to this embodiment, the first cooling unit fins 81 of the first cooling unit 80 are arranged with the first fin pitch P1. The second cooling unit fins 86 of the second cooling units 85 are arranged with the second fin pitch P2. The first fin pitch P1 is shorter than the second fin pitch P2.

When the fin pitch (the first fin pitch P1) between the first cooling unit fins 81 is shorter than the fin pitch (the second fin pitch P2) between the second cooling unit fins 86, heat exchange with the outdoor air flows AF is facilitated in the first cooling unit 80, which leads to improvement in cooling performance. Meanwhile, an airflow volume of outdoor air flows AF passing the first cooling unit 80 needs to be larger than an airflow volume of outdoor air flows AF passing the second cooling units 85 in order that each first cooling unit fin 81 favorably exchanges heat with an outdoor air flow AF. Specifically, when the first cooling unit fins 81 are arranged with a shorter fin pitch (the first fin pitch P1), the number of first cooling unit fins 81 is increased, which leads to improvement in heat radiating performance. However, the first cooling unit fins 81 are arranged at a higher density, which may result in a situation in which an outdoor air flow AF is less prone to favorably pass between two of the first cooling unit fins 81. In view of this, in order to arrange the first cooling unit fins 81 with a shorter fin pitch (the first fin pitch P1), it is necessary to increase an airflow volume of outdoor air flows AF passing the first cooling unit fins 81 in accordance with the fin pitch (the first fin pitch P1) such that an outdoor air flow AF favorably passes between two of the first cooling unit fins 81 from the viewpoint of allowing each first cooling unit fin 81 to satisfactorily exchange heat with an outdoor air flow AF.

In the outdoor unit 10 according to this embodiment, the first cooling unit fins 81 of the first cooling unit 80 are arranged with a fin pitch (the first fin pitch P1) that is shorter than that between the second cooling unit fins 86 of the second cooling units 85. The first cooling unit fins 81 are lower in heightwise position than the outdoor fans 18 and higher in heightwise position than the second cooling unit fins 86 (i.e., closer to the outdoor fans 18 than the second cooling unit fins 86 are). This configuration thus facilitates improvement in cooling performance of the first cooling unit 80.

Specifically, when the fin pitch (the first fin pitch P1) between the first cooling unit fins 81 of the first cooling unit 80 is shorter than the fin pitch (the second fin pitch P2) between the second cooling unit fins 86 of each second cooling unit 85, the number of first cooling unit fins 81 is increased. In addition, the airflow volume of the outdoor air flows AF passing the first cooling unit fins 81 of the first cooling unit 80 is ensured to be larger than the airflow volume of the outdoor air flows AF passing the second cooling unit fins 86. As a result, the airflow volume of the outdoor air flows AF passing the first cooling unit fins 81 is increased in accordance with the fin pitch (the first fin pitch P1) such that an outdoor air flow AF favorably passes between two of the first cooling unit fins 81, which leads to suppression of the situation in which an outdoor air flow AF is less prone to favorably pass between two of the first cooling unit fins 81. This configuration thus facilitates improvement in cooling performance of the first cooling unit 80.

(9-4)

In the outdoor unit 10 according to this embodiment, the high-heat generating electric component 65 includes a power device or a power module larger in heating value upon energization than the fan controlling electric components 66. The outdoor unit 10 according to this embodiment facilitates satisfactory cooling of the high-heat generating electric component 65, and facilitates improvement in reliability even when the high-heat generating electric component 65 has a particularly larger heating value.

(9-5)

In the outdoor unit 10 according to this embodiment, the first cooling unit 80 includes the heat pipes 83 in which the coolant for heat exchange with the high-heat generating electric component 65 is sealed. The heat pipes 83 are interposed between the high-heat generating electric component 65 and the first cooling unit fins 81. In addition, the heat pipes 83 are thermally connected to the high-heat generating electric component 65 and the first cooling unit fins 81. In the outdoor unit 10, as described above, the high-heat generating electric component 65 is cooled by the heat pipes 83 that are excellent in cooling performance. This configuration therefore ensures a larger cooling value of the high-heat generating electric component 65 having a larger heating value, and particularly facilitates improvement in reliability.

(9-6)

In the outdoor unit 10 according to this embodiment, each heat pipe 83 is disposed with its longitudinal axis extending horizontally. This configuration suppresses a situation in which the coolant frozen in each heat pipe 83 bursts the heat pipe 83 (frost bursting). Specifically, the configuration in that each heat pipe 83 is disposed in the horizontal direction suppresses freezing of the coolant even under an environment of low outside temperature. This configuration therefore suppresses decrease in reliability in cooling the electric components using the heat pipes 83.

(9-7)

In the outdoor unit 10 according to this embodiment, the fifth openings 52*e* in the electric component box 50 are lower in heightwise position than the outdoor fans 18 and higher in heightwise position than the first cooling unit fins 81. In other words, the fifth openings 52*e* in the electric component box 50 are on the leeward side of outdoor air flows AF with respect to the first cooling unit fins 81. This configuration suppresses a situation in which outdoor air flows AF for heat exchange with the first cooling unit fins 81 are heated by air to be discharged through the fifth openings 52*e* in the electric component box 50. This configuration thus suppresses a situation in which the air discharged from the electric component box 50 causes a small temperature difference between the first cooling unit fins 81 and the outdoor air flows AF, and suppresses reduction in cooling value of the high-heat generating electric component 65.

(9-8)

In the outdoor unit 10 according to this embodiment, the electric component box 50 includes the top face cover 53 spaced apart from the fifth openings 52*e*, located on the upper side of the electric component box 50, and configured to suppress the entry of liquid into the fifth openings 52*e*. This configuration therefore reliably suppresses the entry of liquid into the electric component box 50 through the fifth openings 52*e*, and improves reliability for a short circuit, corrosion, and the like as to each electric component.

(9-9)

In the outdoor unit 10 according to this embodiment, the board unit 75 includes the compressor control board 76 and the fan control boards 77, the compressor controlling electric component mount portion 75*a* is disposed on the compressor control board 76, and the fan controlling electric component mount portions 75*b* are respectively disposed on the fan control boards 77. The outdoor unit 10 suppresses decrease in reliability even when the high-heat generating electric component 65 and the fan controlling electric components 66 are respectively mounted on different boards as described above.

(10) Modifications

The foregoing embodiment may be appropriately modified as described in the following modifications. It should be noted that these modifications are applicable in conjunction with other modifications insofar as there are no inconsistencies.

(10-1) Modification 1

In the foregoing embodiment, on the assumption that the outdoor unit 10' includes two outdoor fans 18, two fan control boards 77 (fan controlling electric components 66) are arranged side by side in the left-right direction in the electric component box 50. As illustrated in, for example, FIGS. 2 to 4, however, one fan control board 77 may be disposed in the electric component box 50 as to the outdoor unit 10 including one outdoor fan 18. In other words, one of the fan control boards 77 illustrated in, for example, FIGS. 12 and 25 may be appropriately omitted. In such a case, the second cooling unit 85 corresponding to the omitted fan control board 77 is also omitted.

(10-2) Modification 2

In the foregoing embodiment, the board unit 75 includes the compressor control board 76 and the fan control boards 77, the compressor controlling electric component mount portion 75*a* is disposed on the compressor control board 76, and the fan controlling electric component mount portions 75*b* are respectively disposed on the fan control boards 77. In the foregoing embodiment, specifically, the high-heat generating electric component 65 is mounted on the compressor control board 76, and the fan controlling electric components 66 are respectively mounted on the fan control boards 77. In other words, the high-heat generating electric component 65 and the fan controlling electric components 66 are respectively mounted on the different boards.

However, the present invention is not limited thereto. Alternatively, the high-heat generating electric component 65 and the fan controlling electric components 66 may be mounted on a single board. In other words, the compressor controlling electric component mount portion 75*a* and the fan controlling electric component mount portions 75*b* may be disposed on a single board.

This case also produces functions and effects similar to those produced by the foregoing embodiment as long as the first cooling unit 80 (the first cooling unit fins 81) adjacent to the compressor controlling electric component mount portion 75*a* is on the leeward side of air flows with respect to the second cooling units 85 (the second cooling unit fins 86) adjacent to the fan controlling electric component mount portions 75*b* and is closer in heightwise position to the outdoor fans 18 than the second cooling units 85 (the second cooling unit fins 86) are, as described in the foregoing embodiment. In other words, the board unit 75 does not necessarily include a plurality of boards.

(10-3) Modification 3

In the foregoing embodiment, the high-heat generating electric component 65 (the power module) is fixed to the first cooling unit 80 in close contact with the first cooling unit 80 (specifically, the front face part 822*a* of the heat pipe holding part 822). Preferably, the high-heat generating electric component 65 is fixed as described above for the purpose of facilitating heat exchange with the heat pipes 83.

However, the high-heat generating electric component 65 is not necessarily fixed to the first cooling unit 80 in close contact with the first cooling unit 80 as long as a cooling value to be required from the viewpoint of reliability is ensured. For example, the high-heat generating electric component 65 may be in partial contact with the first cooling unit 80. Alternatively, the high-heat generating electric component 65 may be thermally connected to the first cooling unit 80 with any object interposed between the high-heat generating electric component 65 and the first cooling unit 80 or may be cooled by cold radiation from the first cooling unit 80 at a position apart from the first cooling unit 80 as long as the high-heat generating electric component 65 is thermally connected to the first cooling unit 80 and ensures the required cooling value.

(10-4) Modification 4

In the outdoor unit 10 according to the foregoing embodiment, the high-heat generating electric component 65 is lower in heightwise position than the outdoor fans 18 and higher in heightwise position than the fan controlling electric components 66. In this respect, the entire high-heat generating electric component 65 is not necessarily higher in heightwise position than the fan controlling electric components 66 so long as to produce the effect of "facilitating favorable cooling of both the high-heat generating electric component 65 configured to control the compressor and the fan controlling electric components 66 configured to control the outdoor fans 18 and thus suppressing decrease in reliability". In other words, the high-heat generating electric component 65 may be partially superimposed on the fan controlling electric components 66 as seen from the horizontal direction as long as there arises no contradiction as to the functions and effects described in Feature (9-1).

Likewise, the entire high-heat generating electric component 65 is not necessarily lower in heightwise position than the outdoor fans 18. In other words, the high-heat generating electric component 65 may be partially superimposed on the outdoor fans 18 as seen from the horizontal direction as long as there arises no contradiction as to the functions and effects described in Feature (9-1).

(10-5) Modification 5

In the foregoing embodiment, each heat pipe 83 of the first cooling unit 80 is disposed with its longitudinal axis extending horizontally. In this respect, preferably, the heat pipes 83 are disposed as described above from the viewpoint of suppressing frost bursting as to the heat pipes 83. However, the heat pipes 83 are not necessarily disposed as described above as long as the reliability for frost bursting is ensured. For example, each heat pipe 83 may be disposed such that its longitudinal axis extends in a direction crossing the horizontal direction. Alternatively, each heat pipe 83 may be disposed such that its longitudinal axis extends vertically.

(10-6) Modification 6

In the foregoing embodiment, the first cooling unit 80 configured to cool the high-heat generating electric component 65 includes the heat pipes 83. In this respect, preferably, the first cooling unit 80 cools the high-heat generating electric component 65 with the heat pipes 83 as described in the foregoing embodiment from the viewpoint of ensuring a larger cooling value of the high-heat generating electric component 65 having a larger heating value. However, the first cooling unit 80 does not necessarily include the heat pipes 83 as long as a cooling value required for the high-heat generating electric component 65 is ensured from the viewpoint of ensuring reliability.

(10-7) Modification 7

In the foregoing embodiment, the second fin pitch P2 is at least twice as long as the first fin pitch P1. However, the present invention is not limited thereto. The ratio between the first fin pitch P1 and the second fin pitch P2 may be appropriately changed in accordance with design specifications and installation environments as long as there arises no contradiction as to the functions and effects described in Feature (9-1). For example, the second fin pitch P2 may be at least 1.5 times as long as the first fin pitch P1. Alternatively, the second fin pitch P2 may be equal or less than the first fin pitch P1.

(10-8) Modification 8

In the foregoing embodiment, the electric component box 50 includes the top face cover 53 spaced apart from the fifth openings 52*e*, located on the upper side of the electric component box 50, and configured to suppress the entry of liquid into the fifth openings 52*e*. In this respect, preferably, the top face cover 53 is disposed as described above in the foregoing embodiment from the viewpoint of suppressing the entry of liquid into the electric component box 50 through the fifth openings 52*e*. However, the top face cover 53 is not necessarily needed for the purpose of producing the effect of facilitating cooling of the high-heat generating electric component 65 and fan controlling electric components 66. The top face cover 53 may be omitted as long as the reliability for the entry of liquid into the electric component box 50 is ensured.

(10-9) Modification 9

In the foregoing embodiment, the outdoor fans 18 are disposed near the upper end of the outdoor unit casing 40. However, the position of the outdoor fans 18 may be appropriately changed as long as the outdoor fans 18 are capable of providing outdoor air flows AF flowing from below upward in the outdoor unit casing 40 and there arises no contradiction as to the functions and effects described in Feature (9-1). For example, the outdoor fans 18 may be disposed at a heightwise position near a middle of the outdoor unit casing 40.

(10-10) Modification 10

In the foregoing embodiment, the high-heat generating electric component 65 is a power module including a plurality of power devices. However, the high-heat generating electric component 65 is not necessarily limited thereto. For example, the high-heat generating electric component 65 may be any electric component as long as it generates heat when being energized.

(10-11) Modification 11

In the foregoing embodiment, the configuration of the refrigerant circuit RC is not limited to that illustrated in FIG. 1, and may be appropriately changed in accordance with design specifications and installation environments. For example, the accumulator 11 and the outdoor expansion valve 16 may be appropriately omitted if they are not necessarily needed. In addition, the refrigerant circuit RC may additionally include a device (e.g., a receiver) not illustrated in FIG. 1.

(10-12) Modification 12

In the foregoing embodiment, the present invention is applied to the air conditioning system 100 including one outdoor unit 10 and two indoor units 30 connected to the outdoor unit 10 in parallel via the connection pipes (L1, G1). However, a configuration of an air conditioning system to which the present invention is applied is not limited to this configuration. Specifically, as to an air conditioning system to which the present invention is applied, the number of outdoor units 10 and/or indoor units 30 and the connection of an outdoor unit 10 and an indoor unit 30 may be appropriately changed in accordance with installation environments and design specifications.

(10-13) Modification 13

In the foregoing embodiment, the present invention is applied to the air conditioning system 100. However, the present invention is not limited thereto and is applicable to any refrigeration apparatus (e.g., a water heater, a heat pump chiller) including a refrigerant circuit.

INDUSTRIAL APPLICABILITY

The present invention is applicable to an outdoor unit for a refrigeration apparatus.

REFERENCE SIGNS LIST

10, 10': outdoor unit
12: compressor
15: outdoor heat exchanger
18: outdoor fan (fan)
20: outdoor unit control unit
30: indoor unit
40, 40': outdoor unit casing (casing)
41: installation leg

43: bottom frame
45: support
47: front face panel
47*a*: first front face panel
47*b*: second front face panel
49: fan module
50: electric component box
51: front face cover
52: main body frame
52*a*: first opening
52*b*: second opening
52*c*: third opening
52*d*: fourth opening
52*e*: fifth opening (exhaust port)
52*f*: sixth opening
53: top face cover (cover part)
54: first side face cover
55: second side face cover
57: first fitting
58: second fitting
63: compressor controlling electric component
65: high-heat generating electric component (first electric component)
66: fan controlling electric component (second electric component)
71: control board
75: board unit (board part)
75*a*: compressor controlling electric component mount portion (first portion)
75*b*: fan controlling electric component mount portion (second portion)
76: compressor control board (first board)
77: fan control board (second board)
80: first cooling unit (first cooler)
81: first cooling unit fin (first heat radiating fin)
82: first cooling unit main body
82*a*: heat pipe insertion hole
83: heat pipe
85: second cooling unit (second cooler)
86: second cooling unit fin (second heat radiating fin)
87: second cooling unit main body
100: air conditioning system (refrigeration apparatus)
401: intake port
402: blow-out port
501: vertical plate
521: rear face part
522: left side face part
523: right side face part
524: top face part
531: upper cover part
532: left lateral cover part
533: right lateral cover part
541: right-side part
542: front-side part
543: rear-side part
544: upper part
821: fin holding part
822: heat pipe holding part
822*a*: front face part
AF: outdoor air flow (air flow)
M12: compressor motor
M18: outdoor fan motor
P1: first fin pitch
P2: second fin pitch
RC: refrigerant circuit
SP: inner space
SP1: lower space
SP2: upper space
SP2*a*: front-side upper space
SP2*b*: rear-side upper space

CITATION LIST

Patent Literature

Patent Literatue 1: Japanese Patent No. 5,196,66

The invention claimed is:

1. An outdoor unit for a refrigeration apparatus,
the outdoor comprising:
a compressor configured to compress a refrigerant;
a fan configured to provide air flows,
the fan being higher in heightwise position than the compressor;
a power module configured to control a driven state of the compressor;
an electric controller configured to control a driven state of the fan;
a board part, the board part including
a first portion on which the power module is mounted, and
a second portion on which the electric controller is mounted;
a first cooling fin assembly thermally connected to the power module and configured to cool the power module,
the first cooling fin assembly being adjacent to the first portion;
a second cooling fin assembly thermally connected to the electric controller and configured to cool the electric controller,
the second cooling fin assembly being adjacent to the second portion; and
a casing housing therein the compressor, the fan, and the board part and having a blow-out port through which the air flows are blown out upward,
wherein
each of the air flows is a flow of air flowing from below upward in the casing and flowing out of the casing through the blow-out port,
the first cooling fin assembly includes a plurality of first heat radiating fins located on flow paths of the air flows and configured to exchange heat with the air flows,
the second cooling fin assembly includes a plurality of second heat radiating fins configured to exchange heat with the air flows,
the power module is lower in heightwise position than the fan and higher in heightwise position than the electric controller,
the first heat radiating fins are higher in heightwise position than the second heat radiating fins, and
the first heat radiating fins are cooled by the air flows subjected to heat exchange with the second heat radiating fins.

2. The outdoor unit for the refrigeration apparatus according to claim 1, wherein
the first heat radiating fins of the first cooling fin assembly are arranged with a first fin pitch,
the second heat radiating fins of the second cooling fin assembly are arranged with a second fin pitch, and
the first fin pitch is shorter than the second fin pitch.

3. The outdoor unit for the refrigeration apparatus according to claim 1, wherein
the power module is larger in heating value upon energization than the electric controller.

4. The outdoor unit for the refrigeration apparatus according to claim 1, wherein the board part includes a first board and a second board, the first portion is disposed on the first board, and the second portion is disposed on the second board.

5. The outdoor unit for the refrigeration apparatus according to claim 1, wherein the first cooling fin assembly further includes a heat pipe in which a coolant for heat exchange with the power module is sealed, and the heat pipe is interposed between the power module and the first heat radiating fins, and is thermally connected to the power module and the first heat radiating fins.

6. The outdoor unit for the refrigeration apparatus according to claim 5, wherein the heat pipe is disposed with its longitudinal axis extending horizontally.

7. The outdoor unit for the refrigeration apparatus according to claim 1, further comprising:

an electric component box housing therein the board part, the electric component box being disposed in the casing, wherein the electric component box has in its top face an exhaust through which air is discharged, and the exhaust port is lower in heightwise position than the fan and higher in heightwise position than the first heat radiating fins.

8. The outdoor unit for the refrigeration apparatus according to claim 7, wherein the electric component box includes a cover part spaced apart from the plurality of exhaust ports, located on an upper side of the electric component box, and configured to suppress entry of liquid into the plurality of exhaust ports.

* * * * *